US010980093B2

(12) United States Patent
Zhu et al.

(10) Patent No.: US 10,980,093 B2
(45) Date of Patent: Apr. 13, 2021

(54) SYSTEMS AND METHODS FOR SEGMENTED CONSTANT CURRENT CONTROL

(71) Applicant: ON-BRIGHT ELECTRONICS (SHANGHAI) CO., LTD., Shanghai (CN)

(72) Inventors: Liqiang Zhu, Shanghai (CN); Zhuoyan Li, Shanghai (CN); Jiqing Yang, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 16/706,355

(22) Filed: Dec. 6, 2019

(65) Prior Publication Data

US 2020/0221555 A1 Jul. 9, 2020

(30) Foreign Application Priority Data

Dec. 12, 2018 (CN) ..... 201811518638.9

(51) Int. Cl.
*H05B 45/37* (2020.01)

(52) U.S. Cl.
CPC ..... *H05B 45/37* (2020.01)

(58) Field of Classification Search
CPC ..... H05B 45/10; H05B 45/14; H05B 45/24; H05B 45/37; H05B 45/34; H05B 45/345; H05B 45/30; H05B 45/40
See application file for complete search history.

(56) References Cited

U.S. PATENT DOCUMENTS 9,154,153 B2 10/2015 Conroy et al.
9,794,992 B1 * 10/2017 Chu ..... H05B 45/00
(Continued)

FOREIGN PATENT DOCUMENTS

CN 102026442 A 4/2011
CN 103428969 A 12/2013
(Continued)

OTHER PUBLICATIONS

Taiwan Intellectual Property Office, Office Action dated Oct. 8, 2019, in Application No. 108102776.
(Continued)

*Primary Examiner* — Amy Cohen Johnson
*Assistant Examiner* — Syed M Kaiser
(74) *Attorney, Agent, or Firm* — Faegre Drinker Biddle & Reath LLP

(57) ABSTRACT

System and method for current control. As an example, the system for current control includes: a transistor including a drain terminal, a gate terminal, and a source terminal, the drain terminal being coupled to one or more light emitting diodes; a resistor coupled to the source terminal of the transistor and configured to generate a resistor voltage related to a current flowing through the one or more emitting diodes; a voltage detector configured to receiver a first input voltage related to a second input voltage received by the one or more light emitting diodes; and a voltage controller coupled to the voltage detector, the resistor, and the gate terminal of the transistor; wherein the voltage detector is further configured to: detect the first input voltage; and generate a control signal based at least in part on the first input voltage.

30 Claims, 11 Drawing Sheets

(56) References Cited

U.S. PATENT DOCUMENTS

| | | | | |
|---|---|---|---|---|
| 9,960,594 | B1 * | 5/2018 | Lin | H02M 1/32 |
| 10,218,282 | B1 * | 2/2019 | Moore | H05B 45/34 |
| 2003/0057358 | A1 * | 3/2003 | Yuan | H04N 5/335 250/214.1 |
| 2006/0034102 | A1 * | 2/2006 | Yang | H02M 3/33507 363/21.13 |
| 2012/0081009 | A1 * | 4/2012 | Shteynberg | H05B 45/46 315/122 |
| 2012/0112564 | A1 * | 5/2012 | Wu | H02M 1/44 307/326 |
| 2013/0162150 | A1 * | 6/2013 | Masuda | H05B 45/46 315/186 |
| 2013/0181760 | A1 * | 7/2013 | Lin | H03K 3/011 327/299 |
| 2014/0175997 | A1 * | 6/2014 | Wu | H05B 45/395 315/200 R |
| 2015/0357899 | A1 * | 12/2015 | Ekbote | H02M 1/4225 315/224 |
| 2016/0007416 | A1 * | 1/2016 | Viviani | H05B 45/48 315/200 R |
| 2016/0126848 | A1 * | 5/2016 | Sasaki | G02F 1/133603 349/69 |
| 2017/0027034 | A1 * | 1/2017 | Nozawa | H05B 45/00 |
| 2017/0040904 | A1 * | 2/2017 | Kikuchi | H02M 3/33592 |
| 2018/0035500 | A1 * | 2/2018 | Song | H05B 47/10 |
| 2018/0180978 | A1 * | 6/2018 | Yamada | H05B 45/10 |
| 2018/0287479 | A1 * | 10/2018 | Li | H02M 3/33507 |
| 2018/0376557 | A1 * | 12/2018 | Beij | H05B 45/10 |
| 2019/0074772 | A1 * | 3/2019 | Pollischansky | H02M 1/08 |
| 2019/0110349 | A1 * | 4/2019 | Tsukahara | G03B 21/2033 |
| 2019/0141816 | A1 * | 5/2019 | Zhu | H05B 45/50 |
| 2019/0207520 | A1 * | 7/2019 | Imade | H02M 3/33507 |
| 2019/0260280 | A1 * | 8/2019 | Yao | H02M 1/14 |
| 2020/0169160 | A1 * | 5/2020 | Kikuchi | H02M 1/4208 |

FOREIGN PATENT DOCUMENTS

| | | | |
|---|---|---|---|
| CN | 103442484 | A | 12/2013 |
| CN | 106793277 | A | 5/2017 |
| CN | 106851906 | A | 6/2017 |
| CN | 106912144 | A | 6/2017 |
| TW | 201117662 | | 5/2011 |
| TW | M501708 | | 5/2015 |
| TW | 201804873 | | 2/2018 |

OTHER PUBLICATIONS

China Intellectual Property Office, Office Action dated Apr. 26, 2020, in Application No. 201811518638.9.

* cited by examiner

SYSTEMS AND METHODS FOR SEGMENTED CONSTANT CURRENT CONTROL

1. CROSS-REFERENCES TO RELATED APPLICATIONS

This application claims priority to Chinese Patent Application No. 201811518638.9, filed Dec. 12, 2018, incorporated by reference herein for all purposes.

2. BACKGROUND OF THE INVENTION

Certain embodiments of the present invention are directed to integrated circuits. More particularly, some embodiments of the invention provide systems and methods for segmented constant current control. Merely by way of example, some embodiments of the invention have been applied to light emitting diode (LED) lighting systems. But it would be recognized that the invention has a much broader range of applicability.

Linear constant current LED drivers have been widely used for LED lighting systems. These lighting systems often have simple and reliable structures with low costs. FIG. 1 is a simplified diagram showing a conventional LED lighting system with linear constant current control. The LED lighting system 100 includes a bridge rectifier 110, an operational amplifier 120, a transistor 130, a capacitor 140, a resistor 150, and one or more light emitting diodes (LEDs) 160. In some examples, the transistor 130 is used to regulate a current 162 (e.g., $I_{LED}$) that flows through the one or more LEDs 160, and the resistor 150 is used to sense the current 162 (e.g., $I_{LED}$).

After the LED lighting system 100 is powered on, an AC supply voltage 170 (e.g., VAC) is received by the bridge rectifier 110 (e.g., a full-wave rectifier), which generates an input voltage 112 (e.g., $V_{in}$). Additionally, the operational amplifier 120 generates a gate voltage 122 to turn on the transistor 130, which also has a drain voltage 132 (e.g., $V_{drain}$). For example, the operational amplifier 120 includes an output terminal 121 and generates the gate voltage 122 at the output terminal 121, and the gate voltage 122 is received by the gate terminal of the transistor 130. If the input voltage 112 (e.g., $V_{in}$) minus the drain voltage 132 (e.g., $V_{drain}$) becomes larger than the forward bias voltage of the one or more LEDs 160, the current 162 (e.g., $I_{LED}$) flows through the one or more LEDs 160, the transistor 130, and the resistor 150. In response, the resistor 150 generates a sensing voltage 152 (e.g., $V_{sense}$) that corresponds to the magnitude of the current 162 (e.g., $I_{LED}$). The sensing voltage 152 (e.g., $V_{sense}$) is also the source voltage of the transistor 130. For example, the resistor 150 includes terminals 149 and 151. The terminal 149 is biased to a ground voltage, and the terminal 151 is connected to the source terminal of the transistor 130. As an example, the resistor 150 generates the sensing voltage 152 (e.g., $V_{sense}$) at the terminal 151. The operational amplifier 120 receives the sensing voltage 152 (e.g., $V_{sense}$) and a reference voltage 124 (e.g., $V_{ref}$), compares the voltages 124 and 152 (e.g., determines a difference between the voltages 124 and 152), and adjusts the gate voltage 122 to keep the current 162 at a constant magnitude. For example, the reference voltage 124 (e.g., $V_{ref}$) is used to determine the constant magnitude of the current 162.

As shown in FIG. 1, when regulating the current 162 (e.g., $I_{LED}$), the transistor 130 often consumes significant energy, thus adversely affecting the efficiency of the LED lighting system 100. Hence it is highly desirable to improve the current regulation techniques.

3. BRIEF SUMMARY OF THE INVENTION

Certain embodiments of the present invention are directed to integrated circuits. More particularly, some embodiments of the invention provide systems and methods for segmented constant current control. Merely by way of example, some embodiments of the invention have been applied to light emitting diode (LED) lighting systems. But it would be recognized that the invention has a much broader range of applicability.

According to some embodiments, a system for current control includes: a transistor including a drain terminal, a gate terminal, and a source terminal, the drain terminal being coupled to one or more light emitting diodes; a resistor coupled to the source terminal of the transistor and configured to generate a resistor voltage related to a current flowing through the one or more emitting diodes; a voltage detector configured to receiver a first input voltage related to a second input voltage received by the one or more light emitting diodes; and a voltage controller coupled to the voltage detector, the resistor, and the gate terminal of the transistor; wherein the voltage detector is further configured to: detect the first input voltage; and generate a control signal based at least in part on the first input voltage; wherein the voltage controller is configured to: receive the control signal from the voltage detector; receive the resistor voltage from the resistor; use at least the resistor voltage and one reference voltage of a plurality of reference voltages based at least in part on the control signal to generate a gate voltage; and output the gate voltage to the gate terminal of the transistor; wherein: if the first input voltage becomes larger than a predetermined voltage magnitude, the one reference voltage changes from a first reference voltage of the plurality of reference voltages to a second reference voltage of the plurality of reference voltages; and if the first input voltage becomes smaller than the predetermined voltage magnitude, the one reference voltage changes from the second reference voltage to the first reference voltage; wherein the first reference voltage is larger than the second reference voltage.

According to certain embodiments, a method for current control includes: receiving, by a resistor, a current flowing through one or more light emitting diodes, the resistor being coupled to a source terminal of a transistor, the transistor further including a gate terminal and a drain terminal coupled to the one or more light emitting diodes; generating a resistor voltage related to the current flowing through the one or more emitting diodes; receiving a first input voltage related to a second input voltage received by the one or more light emitting diodes; detecting the first input voltage; generating a control signal based at least in part on the first input voltage; receiving the resistor voltage and the control signal; using at least the resistor voltage and one reference voltage of a plurality of reference voltages based at least in part on the control signal to generate a gate voltage; and outputting the gate voltage to the gate terminal of the transistor; wherein: if the first input voltage becomes larger than a predetermined voltage magnitude, the one reference voltage changes from a first reference voltage of the plurality of reference voltages to a second reference voltage of the plurality of reference voltages; and if the first input voltage becomes smaller than the predetermined voltage magnitude, the one reference voltage changes from the second reference voltage to the first reference voltage; wherein the first reference voltage is larger than the second reference voltage.

Depending upon embodiment, one or more benefits may be achieved. These benefits and various additional objects, features and advantages of the present invention can be fully appreciated with reference to the detailed description and accompanying drawings that follow.

4. BRIEF DESCRIPTION OF THE DRAWINGS

5. DETAILED DESCRIPTION OF THE INVENTION

Certain embodiments of the present invention are directed to integrated circuits. More particularly, some embodiments of the invention provide systems and methods for segmented constant current control. Merely by way of example, some embodiments of the invention have been applied to light emitting diode (LED) lighting systems. But it would be recognized that the invention has a much broader range of applicability.

Figure 1:
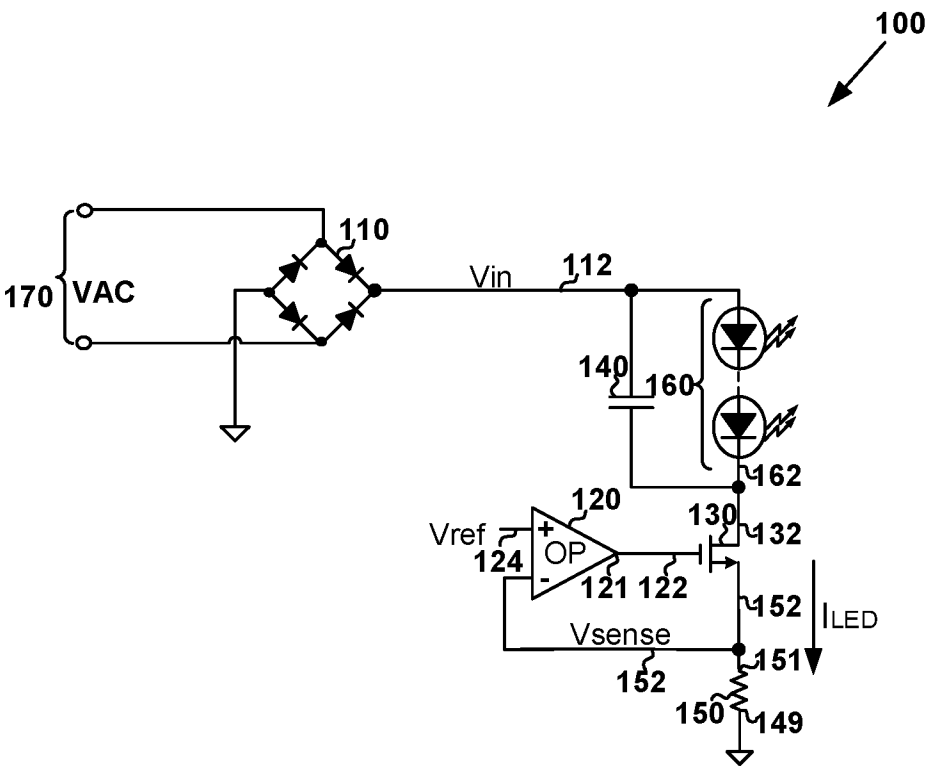
FIG. 1 Prior Art
FIG. 1 is a simplified diagram showing a conventional LED lighting system with linear constant current control.

As shown in FIG. 1, as an example, the power consumption of the transistor 130 is determined as follows:

$$P_M=(V_{drain}-V_{sense})\times I_{LED} \quad \text{(Equation 1)}$$

where $P_M$ represents the power consumption of the transistor 130, $V_{drain}$ represents the drain voltage 132 of the transistor 130, $V_{sense}$ represents the source voltage 152 of the transistor 130, and $I_{LED}$ represents the current 162 that flows through the transistor 130. For example, the current 162 (e.g., $I_{LED}$) is kept at a predetermined constant current magnitude and the source voltage 152 (e.g., $V_{sense}$) is kept at a corresponding constant voltage magnitude, so the power consumption (e.g., $P_M$) of the transistor 130 depends on the drain voltage 132 (e.g., $V_{drain}$) of the transistor 130 as shown by Equation 1.

In some examples, the drain voltage 132 (e.g., $V_{drain}$) of the transistor 130 is determined as follows:

$$V_{drain}=V_{in}-V_{LED} \quad \text{(Equation 2)}$$

where $V_{drain}$ represents the drain voltage 132 of the transistor 130, yin represents the input voltage 112, and $V_{LED}$ represents the forward bias voltage of the one or more LEDs 160. As an example, the input voltage 112 (e.g., $V_{in}$) is a rectified voltage that changes with time. In some examples, the drain voltage 132 (e.g., $V_{drain}$) is larger when the input voltage 112 (e.g., $V_{in}$) is at its peak magnitude according to Equation 2. For example, as shown by Equation 1, when the input voltage 112 (e.g., $V_{in}$) is at its peak magnitude, the power consumption of the transistor 130 is also larger, lowering the energy efficiency of the LED lighting system 100.

Figure 2:
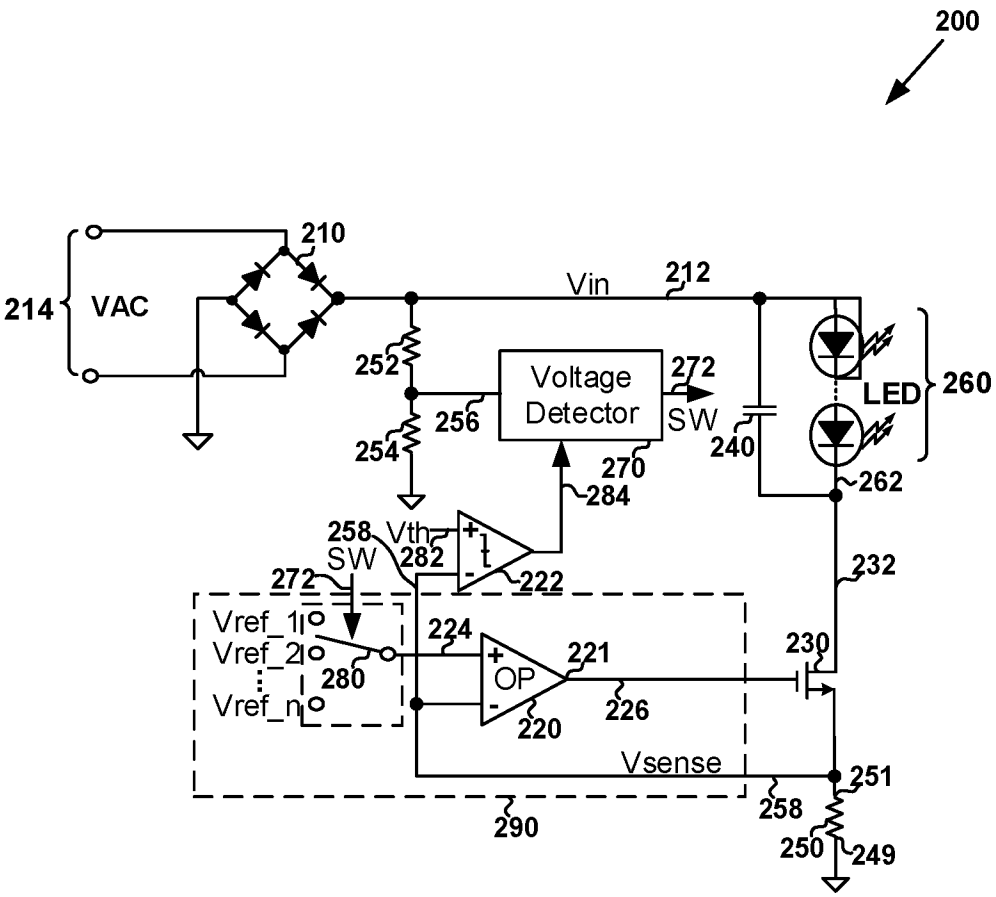
FIG. 2 is a simplified diagram showing an LED lighting system according to some embodiments of the present invention.

FIG. 2 is a simplified diagram showing an LED lighting system according to some embodiments of the present invention. This diagram is merely an example, which should not unduly limit the scope of the claims. One of ordinary skill in the art would recognize many variations, alternatives, and modifications. The LED lighting system 200 includes a bridge rectifier 210, a comparator 222, a transistor 230, a capacitor 240, resistors 250, 252 and 254, one or more light emitting diodes (LEDs) 260, a voltage detector 270, and a gate voltage controller 290. In certain examples, the gate voltage controller 290 includes an operational amplifier 220 and a switch 280. For example, the operational amplifier 220, the comparator 222, the transistor 230, the resistors 250, 252 and 254, the voltage detector 270, and the switch 280 are used to perform segmented constant current control. In some examples, the transistor 230 is used to regulate a current 262 (e.g., $I_{LED}$) that flows through the one or more LEDs 260, and the resistor 250 is used to sense the current 262 (e.g., $I_{LED}$). Although the above has been shown using a selected group of components for the system, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

According to certain embodiments, after the LED lighting system 200 is powered on, an AC supply voltage 214 (e.g., VAC) is received by the bridge rectifier 210 (e.g., a full-wave rectifier), which generates an input voltage 212 (e.g., $V_{in}$). As an example, the input voltage 212 (e.g., $V_{in}$) is received by the resistor 252, the capacitor 240, and the one or more LEDs 260. In some examples, the resistors 252 and 254, as parts of a voltage divider, use the input voltage 212 (e.g., $V_{in}$) to generate a voltage 256 (e.g., $V_s$). For example, the voltage 256 (e.g., $V_s$) is directly proportional to the input voltage 212 (e.g., $V_{in}$). As an example, the voltage 256 (e.g., $V_s$) increases with the increasing input voltage 212 (e.g., $V_{in}$), and the voltage 256 (e.g., $V_s$) decreases with the decreasing input voltage 212 (e.g., $V_{in}$). In certain examples, the voltage 256 (e.g., $V_s$) is received by the voltage detector 270, which also receives a control signal 284 from the comparator 222. As an example, in response, the voltage detector 270 generates a control signal 272, which is received by the switch 280.

According to some embodiments, the switch 280 receives the control signal 272, selects one voltage from multiple voltages, and sends the selected voltage as a reference voltage 224 (e.g., $V_{ref}$) to the operational amplifier 220. In some examples, the multiple voltages include voltages $V_{ref_1}$, $V_{ref_2}$, . . . , and $V_{ref_n}$, where n is a positive integer equal to or larger than 2. As an example, $V_{ref_j}$ is smaller than $V_{ref_1}$, if j is larger than i, where i is a positive integer smaller than n and j is a positive integer smaller than or equal to n. In certain examples, when the voltage 256 (e.g., $V_s$) increases, the selected voltage used as the reference voltage 224 (e.g., $V_{ref}$) decreases in magnitude.

In certain embodiments, the operational amplifier 220 generates a gate voltage 226 to turn on the transistor 230, which also has a drain voltage 232 (e.g., $V_{drain}$). For example, the operational amplifier 220 includes an output terminal 221 and generates the gate voltage 226 at the output terminal 221, and the gate voltage 226 is received by the gate terminal of the transistor 230. In some examples, if the input voltage 212 (e.g., $V_{in}$) minus the drain voltage 232 (e.g., $V_{drain}$) becomes larger than the forward bias voltage of the one or more LEDs 260, the current 262 (e.g., $I_{LED}$) flows through the one or more LEDs 260, the transistor 230, and the resistor 250. As an example, in response, the resistor 250 generates a sensing voltage 258 (e.g., $V_{sense}$) that corresponds to the magnitude of the current 262 (e.g., $I_{LED}$). For example, the sensing voltage 258 (e.g., $V_{sense}$) is also the source voltage of the transistor 230. In certain examples, the resistor 250 includes terminals 249 and 251. As an example, the terminal 249 is biased to a ground voltage, and the terminal 251 is connected to the source terminal of the transistor 230. For example, the resistor 250 generates the sensing voltage 258 (e.g., $V_{sense}$) at the terminal 251.

In some examples, the operational amplifier 220 receives the sensing voltage 258 (e.g., $V_{sense}$) and the reference voltage 224 (e.g., $V_{ref}$), compares the voltages 224 and 258, (e.g., determines a difference between the voltages 224 and 258), and adjusts the gate voltage 226 to keep the current 262 at a constant magnitude. For example, the reference voltage 224 (e.g., $V_{ref}$) is used to determine the constant magnitude of the current 262. In some examples, the comparator 222 receives the sensing voltage 258 (e.g., $V_{sense}$) and a threshold voltage 282 (e.g., $V_{th}$), compares the sensing voltage 258 (e.g., $V_{sense}$) and the threshold voltage 282 (e.g., $V_{th}$), and generate the control signal 284, which is received by the voltage detector 270.

Figure 6:
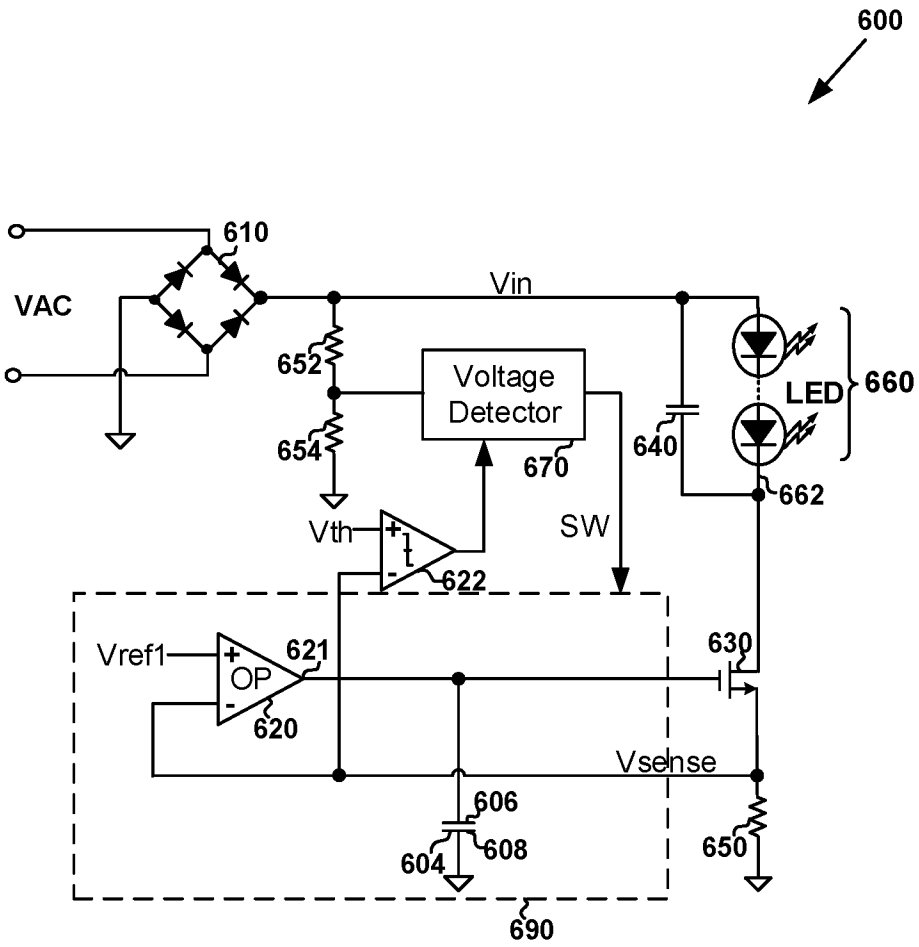
FIG. 6 is a simplified diagram showing certain modifications to the LED lighting system as shown in FIG. 2 and/or the LED lighting system as shown in FIG. 5 according to some embodiments of the present invention.

As discussed above and further emphasized here, FIG. 2 is merely an example, which should not unduly limit the scope of the claims. One of ordinary skill in the art would recognize many variations, alternatives, and modifications. For example, if the switch 280 selects $V_{ref_1}$ from the multiple voltages $V_{ref_1}$, $V_{ref_2}$, . . . , and $V_{ref_n}$, and sends $V_{ref_1}$ as the reference voltage 224 (e.g., $V_{ref}$) to the operational amplifier 220, the output terminal 221 of the operational amplifier 220 is connected to a terminal of a capacitor that includes another terminal biased to the ground voltage as shown in FIG. 6 according to some embodiments.

Figure 3:
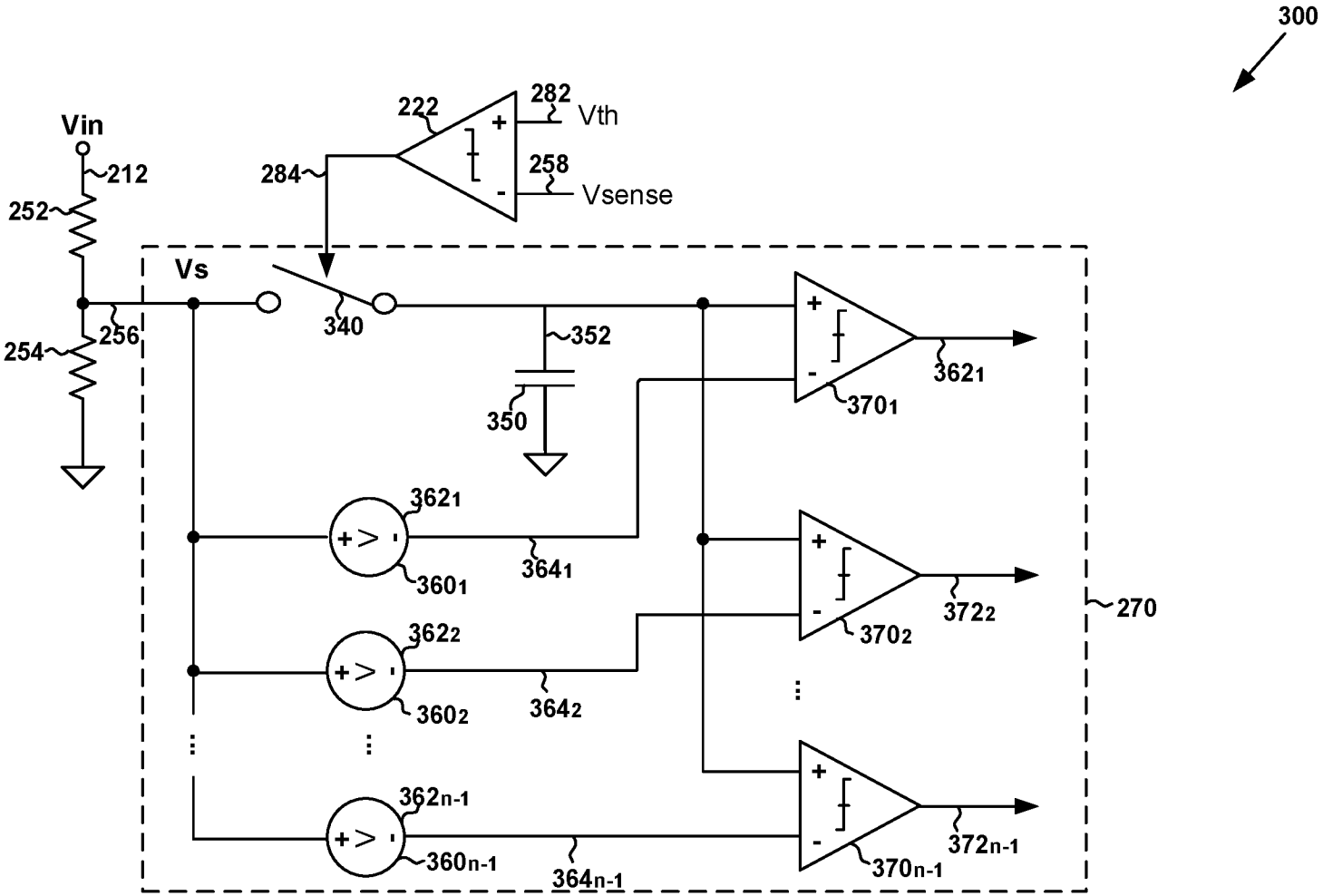
FIG. 3 is a simplified diagram showing certain components of the LED lighting system as shown in FIG. 2 according to certain embodiments of the present invention.

FIG. 3 is a simplified diagram showing certain components of the LED lighting system 200 as shown in FIG. 2 according to certain embodiments of the present invention. This diagram is merely an example, which should not unduly limit the scope of the claims. One of ordinary skill in the art would recognize many variations, alternatives, and modifications. The voltage detector 270 includes a switch 340, a capacitor 350, voltage sources $\mathbf{360}_1$, $\mathbf{360}_2$, . . . , and $\mathbf{360}_{n-1}$, and comparators $\mathbf{370}_1$, $\mathbf{370}_2$, . . . , and $\mathbf{370}_{n-1}$, where n is a positive integer equal to or larger than 2. Although the above has been shown using a selected group of components for the system, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

In some embodiments, the resistors 252 and 254, as parts of a voltage divider, use the input voltage 212 (e.g., $V_{th}$) to generate a voltage 256 (e.g., $V_s$). For example, the voltage 256 (e.g., $V_s$) is received by the switch 340 and the voltage sources $\mathbf{360}_1$, $\mathbf{360}_2$, . . . , and $\mathbf{360}_{n-1}$. In certain embodiments, the comparator 222 receives the sensing voltage 258 (e.g., $V_{sense}$) and the threshold voltage 282 (e.g., $V_{th}$), and generate the control signal 284. As an example, the control signal 284 is received by the switch 340.

In certain embodiments, if the input voltage 212 (e.g., $V_{in}$) minus the drain voltage 232 (e.g., $V_{drain}$) is smaller than the forward bias voltage of the one or more LEDs 260, the current 262 (e.g., $I_{LED}$) does not flows through the one or more LEDs 260, the transistor 230, and the resistor 250, and the current 262 (e.g., $I_{LED}$) is equal to zero in magnitude. As an example, the sensing voltage 258 (e.g., $V_{sense}$) is equal to the ground voltage and is received by the comparator 222. For example, the comparator 222 compares the sensing voltage 258 (e.g., $V_{sense}$) and the threshold voltage 282 (e.g., $V_{th}$) and generate the control signal 284 at a logic high level. In some example, the control signal 284 at the logic high level is received by the switch 340, and in response, the switch 340 is closed and the voltage 352 of the capacitor 350 is equal to the voltage 256 (e.g., $V_s$).

According to some embodiments, if the input voltage 212 (e.g., $V_{in}$) rises and if the input voltage 212 (e.g., $V_{in}$) minus the drain voltage 232 (e.g., $V_{drain}$) becomes larger than the forward bias voltage of the one or more LEDs 260, the current 262 (e.g., $I_{LED}$) starts flowing through the one or more LEDs 260, the transistor 230, and the resistor 250 and the current 262 (e.g., $I_{LED}$) becomes larger than zero in magnitude. In certain examples, if the sensing voltage 258 (e.g., $V_{sense}$) becomes larger than the threshold voltage 282 (e.g., $V^{th}$), the comparator 222 changes the control signal 284 from the logic high level to a logic low level and the switch 340 becomes open. For example, if the switch 340 becomes open, the voltage 352 of the capacitor 350 is kept at a constant magnitude (e.g., $V_{s_t}$) that corresponds to the threshold voltage 282 (e.g., $V_{th}$). As an example, if the voltage 256 (e.g., $V_s$) is equal to the constant magnitude (e.g., $V_{s_t}$), the sensing voltage 258 (e.g., $V_{sense}$) is equal to the threshold voltage 282 (e.g., $V_{th}$).

According to certain embodiments, the voltage sources $\mathbf{360}_1$, $\mathbf{360}_2$, . . . , and $\mathbf{360}_{n-1}$ generate corresponding voltages $\mathbf{362}_1$ (e.g., $V_{b_1}$), $\mathbf{362}_2$ (e.g., $V_{b_2}$), . . . , and $\mathbf{362}_{n-1}$ (e.g., $V_{b_n-1}$) respectively, where n is a positive integer equal to or larger than 2. For example, each voltage of the voltages $\mathbf{362}_1$ (e.g., $V_{b_1}$), $\mathbf{362}_2$ (e.g., $V_{b_2}$), . . . , and $\mathbf{362}_{n-1}$ (e.g., $V_{b_n-1}$) is larger than zero in magnitude. As an example, $V_{b_j}$ is larger than $V_{b_i}$, if j is larger than i, where i is a positive integer smaller than n−1 and j is a positive integer smaller than or equal to n−1. In some examples, each voltage source of the voltage sources $\mathbf{360}_1$, $\mathbf{360}_2$, . . . , and $\mathbf{360}_{n-1}$ receives the voltage 256 (e.g., $V_s$), and the voltage sources $\mathbf{360}_1$, $\mathbf{360}_2$, . . . , and $\mathbf{360}_{n-1}$ output corresponding voltages $\mathbf{364}_1$, $\mathbf{364}_2$, . . . , and $\mathbf{364}_{n-1}$ respectively. For example, the voltages $\mathbf{364}_k$ is equal to the voltage 256 (e.g., $V_s$) minus the voltage $\mathbf{362}_k$ (e.g., $V_{b_k}$), where k is a positive integer smaller than or equal to n−1. In certain examples, each comparator of the comparators $\mathbf{370}_1$, $\mathbf{370}_2$, . . . , and $\mathbf{370}_{n-1}$ receives the voltage 352 of the capacitor 350. As an example, the comparators $370_1$, $370_2$, . . . , and $370_{n-1}$ also receive the corresponding voltages $364_1$, $364_2$, . . . , and $364_m$, respectively, and generates corresponding comparison signals $372_1$, $372_2$, . . . , and $372_{n-1}$ respectively. For example, the comparator $370_m$ compares the voltage 352 and the voltage $364_m$, and generates the comparison signal $372_m$, where m is a positive integer smaller than or equal to n−1.

In some embodiments, if the switch 340 is closed, each comparison signal of the comparison signals $372_1$, $372_2$, . . . , and $372_{n-1}$ is at a logic high level. In certain embodiments, if the switch 340 is open, the comparison signals $372_1$, $372_2$, . . . , and $372_{n-1}$ depend on the voltage 256 (e.g., $V_s$). For example, if the switch 340 is open and if the voltage 256 (e.g., $V_s$) is smaller than the constant magnitude (e.g., $V_{s_t}$) plus the voltages $362_1$ (e.g., $V_{b_1}$), each of the voltages $364_1$, $364_2$, . . . , and $364_{n-1}$ is smaller than the voltage 352, and each comparison signal of the comparison signals $372_1$, $372_2$, . . . , and $372_{n-1}$ is at the logic high level. As an example, if the switch 340 is open and if the voltage 256 (e.g., $V_s$) is larger than the constant magnitude (e.g., $V_{s_t}$) plus the voltages $362_{q-1}$ (e.g., $V_{b_q-1}$) but is smaller than the constant magnitude (e.g., $V_{s_t}$) plus the voltages $362_q$ (e.g., $V_{b_q-1}$), each comparison signal of the comparison signals $372_1$, . . . $372_{q-1}$ is at a logic low level, and each comparison signal of the comparison signals $372_q$, $372_{n-1}$ is at the logic high level, where q is a positive integer larger than 2 and smaller than or equal to n−1. For example, if the switch 340 is open and if the voltage 256 (e.g., $V_s$) becomes larger than the constant magnitude (e.g., $V_{s_t}$) plus the voltages $362_{n-1}$ (e.g., $V_{b_n}$), each of the voltages $364_1$, $364_2$, . . . , and $364_{n-1}$ is larger than the voltage 352, and each comparison signal of the comparison signals $372_1$, $372_2$, . . . , and $372_{n-1}$ is at the logic low level.

As shown in FIG. 2 and FIG. 3, the control signal 272 includes the comparison signals $372_1$, $372_2$, . . . , and $372_{n-1}$ according to certain embodiments. In some examples, if each comparison signal of the comparison signals $372_1$, $372_2$, . . . , and $372_{n-1}$ is at the logic high level, the voltage $V_{ref_1}$ is selected by the switch 280 to be the reference voltage 224 (e.g., $V_{ref}$). In certain examples, if each comparison signal of the comparison signals $372_1$, . . . $372_{q-1}$ is at the logic low level, and each comparison signal of the comparison signals $372_q$, $372_{n-1}$ is at the logic high level, the voltage $V_{ref_q}$ is selected by the switch 280 to be the reference voltage 224 (e.g., $V_{ref}$), where q is a positive integer larger than 2 and smaller than or equal to n−1. In some examples, if each comparison signal of the comparison signals $372_1$, $372_2$, . . . , and $372_{n-1}$ is at the logic low level, the voltage $V_{ref_n}$ is selected by the switch 280 to be the reference voltage 224 (e.g., $V_{ref}$).

According to some embodiments, $V_{ref_j}$ is smaller than $V_{ref_i}$, if j is larger than i, where i is a positive integer smaller than n and j is a positive integer smaller than or equal to n. In certain examples, when the voltage 256 (e.g., $V_s$) increases, the selected voltage used as the reference voltage 224 (e.g., $V_{ref}$) decreases in magnitude. In some examples, when the voltage 256 (e.g., $V_s$) increases, the constant magnitude of the current 262 decreases. For example, if the voltage 256 (e.g., $V_s$) is equal to a lower voltage magnitude, the reference voltage 224 (e.g., $V_{ref}$) is larger and the current 262 is kept at a higher constant magnitude independent of time. As an example, if the voltage 256 (e.g., $V_s$) is equal to a higher voltage magnitude, the reference voltage 224 (e.g., $V_{ref}$) is smaller and the current 262 is kept at a lower constant magnitude independent of time.

In some embodiments, if the input voltage 212 (e.g., $V_{in}$) is equal to a lower voltage magnitude, the current 262 is kept at a higher constant magnitude independent of time, and if the input voltage 212 (e.g., $V_{in}$) is equal to a higher voltage magnitude, the current 262 is kept at a lower constant magnitude independent of time. For example, as shown in Equations 1 and 2, reducing the constant magnitude of the current 262 when the input voltage 212 (e.g., $V_{in}$) increases can lower the power consumption of the transistor 230 (e.g., when the input voltage 212 (e.g., $V_{in}$) reaches its peak magnitude) and improve the energy efficiency of the LED lighting system 200.

Figure 4:
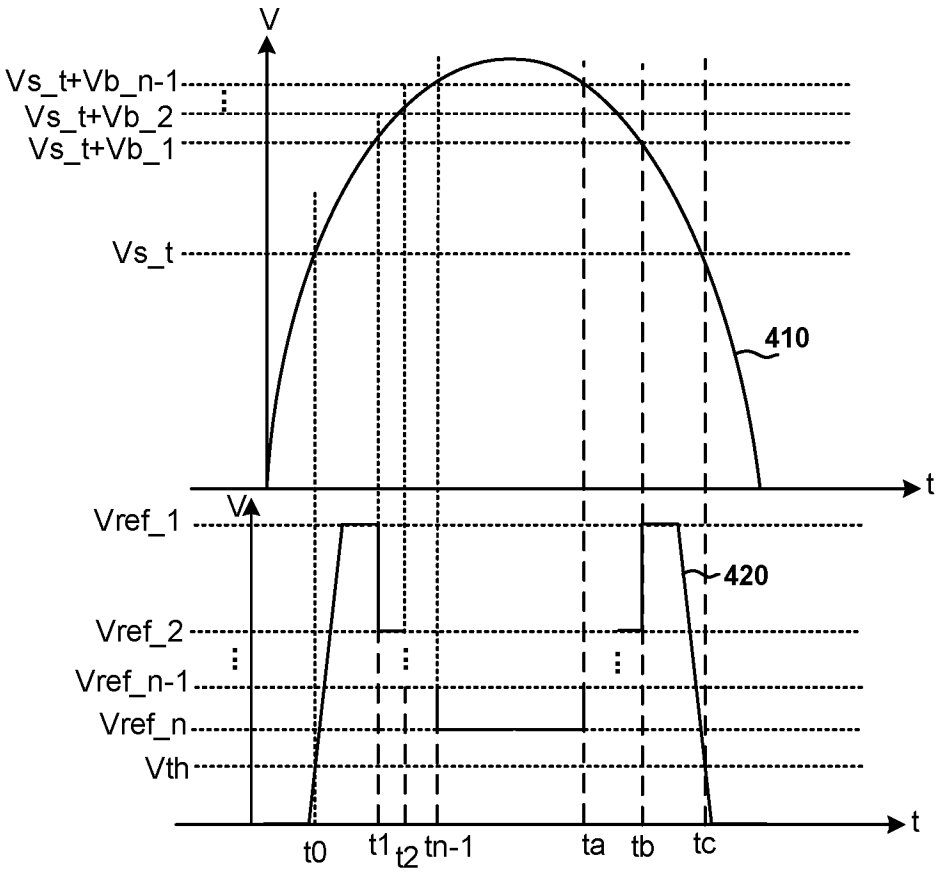
FIG. 4 is a simplified timing diagram for the LED lighting system as shown in FIG. 2 and FIG. 3 according to certain embodiments of the present invention.

FIG. 4 is a simplified timing diagram for the LED lighting system 200 as shown in FIG. 2 and FIG. 3 according to certain embodiments of the present invention. This diagram is merely an example, which should not unduly limit the scope of the claims. One of ordinary skill in the art would recognize many variations, alternatives, and modifications. The waveform 410 represents the voltage 256 (e.g., $V_s$) as a function of time, and the waveform 420 represents the sensing voltage 258 (e.g., $V_{sense}$) as a function of time. For example, the waveforms 410 and 420 covers only one period for the voltage 256 (e.g., $V_s$), corresponding to a half period of the AC supply voltage 214 (e.g., VAC).

In certain embodiments, as shown by the waveform 410, when t is smaller than $t_1$, the voltage 256 (e.g., $V_s$) is smaller than the constant magnitude (e.g., $V_{s_t}$) plus the voltages $362_1$ (e.g., $V_{b_1}$) and the reference voltage 224 (e.g., $V_{ref}$) remains to be the voltage $V_{ref_1}$. As an example, as shown by the waveform 420, when t is smaller than $t_1$, the sensing voltage 258 (e.g., $V_{sense}$) rises up to the voltage $V_{ref_1}$ and then remains at the voltage $V_{ref_1}$. For example, at t equal to to, as shown by the waveforms 410 and 420, the sensing voltage 258 (e.g., $V_{sense}$) is equal to the threshold voltage 282 (e.g., $V_{th}$), and the voltage 256 (e.g., $V_s$) is equal to the constant magnitude (e.g., $V_{s_t}$).

In some embodiments, as shown by the waveform 410, at t equal to $t_1$, the voltage 256 (e.g., $V_s$) becomes larger than the constant magnitude (e.g., $V_{s_t}$) plus the voltages $362_1$ (e.g., $V_{b_1}$) but smaller than the constant magnitude (e.g., $V_{s_t}$) plus the voltages $362_2$ (e.g., $V_{b_2}$), and the reference voltage 224 (e.g., $V_{ref}$) becomes equal to the voltage $V_{ref_2}$. As an example, as shown by the waveform 420, at t equal to $t_1$, the sensing voltage 258 (e.g., $V_{sense}$) drops to the voltage $V_{ref_2}$.

In some embodiments, as shown by the waveform 410, when t larger than $t_1$ but smaller than $t_2$, the voltage 256 (e.g., $V_s$) remains larger than the constant magnitude (e.g., $V_{s_t}$) plus the voltages $362_1$ (e.g., $V_{b_1}$) but smaller than the constant magnitude (e.g., $V_{s_t}$) plus the voltages $362_2$ (e.g., $V_{b_2}$), and the reference voltage 224 (e.g., $V_{ref}$) remains to be the voltage $V_{ref_2}$. As an example, as shown by the waveform 420, when t larger than $t_1$ but smaller than $t_2$, the sensing voltage 258 (e.g., $V_{sense}$) remains at the voltage $V_{ref_2}$.

In certain embodiments, as shown by the waveform 410, at t equal to $t_{n-1}$, the voltage 256 (e.g., $V_s$) becomes larger than the constant magnitude (e.g., $V_{s_t}$) plus the voltages $362_{n-1}$ (e.g., $V_{b_n-1}$), and the reference voltage 224 (e.g., $V_{ref}$) becomes the voltage $V_{ref_n}$. As an example, as shown by the waveform 420, at t equal to $t_{n-1}$, the sensing voltage 258 (e.g., $V_{sense}$) drops to the voltage $V_{ref_n}$.

In some embodiments, as shown by the waveform 410, when t larger than $t_{n-1}$ but smaller than $t_a$, the reference voltage 224 (e.g., $V_{ref}$) remains to be the voltage $V_{ref_n}$. As an example, as shown by the waveform 420, when t larger than $t_{n-1}$ but smaller than $t_a$, the sensing voltage 258 (e.g., $V_{sense}$) remains at the voltage $V_{ref_n}$. For example, at t equal to $t_a$, the voltage 256 (e.g., $V_s$) becomes smaller than the constant magnitude (e.g., $V_{s_t}$) plus the voltages $\mathbf{362}_{n-1}$ (e.g., $V_{b_n-1}$).

As shown in FIG. 4, in certain embodiments, as shown by the waveform 410, at t equal to $t_a$, the voltage 256 (e.g., $V_s$) becomes smaller than the constant magnitude (e.g., $V_{s_t}$) plus the voltages $\mathbf{362}_{n-1}$ (e.g., $V_{b_n-1}$), and the reference voltage 224 (e.g., $V_{ref}$) becomes the voltage $V_{ref_n-1}$. As an example, as shown by the waveform 420, at t equal to $t_a$, the sensing voltage 258 (e.g., $V_{sense}$) rises to the voltage $V_{ref_n-1}$. In some embodiments, as shown by the waveform 410, at t equal to tb, the voltage 256 (e.g., $V_s$) becomes smaller than the constant magnitude (e.g., $V_{s_t}$) plus the voltages $\mathbf{362}_1$ (e.g., $V_{b_1}$), and the reference voltage 224 (e.g., $V_{ref}$) becomes equal to the voltage $V_{ref_1}$. As an example, as shown by the waveform 420, at t equal to tb, the sensing voltage 258 (e.g., $V_{sense}$) rises to the voltage $V_{ref_1}$. In certain embodiments, at t equal to to, as shown by the waveforms 410 and 420, the sensing voltage 258 (e.g., $V_{sense}$) is equal to the threshold voltage 282 (e.g., $V_{th}$), and the voltage 256 (e.g., $V_s$) is equal to the constant magnitude (e.g., $V_{s_t}$).

Figure 5:
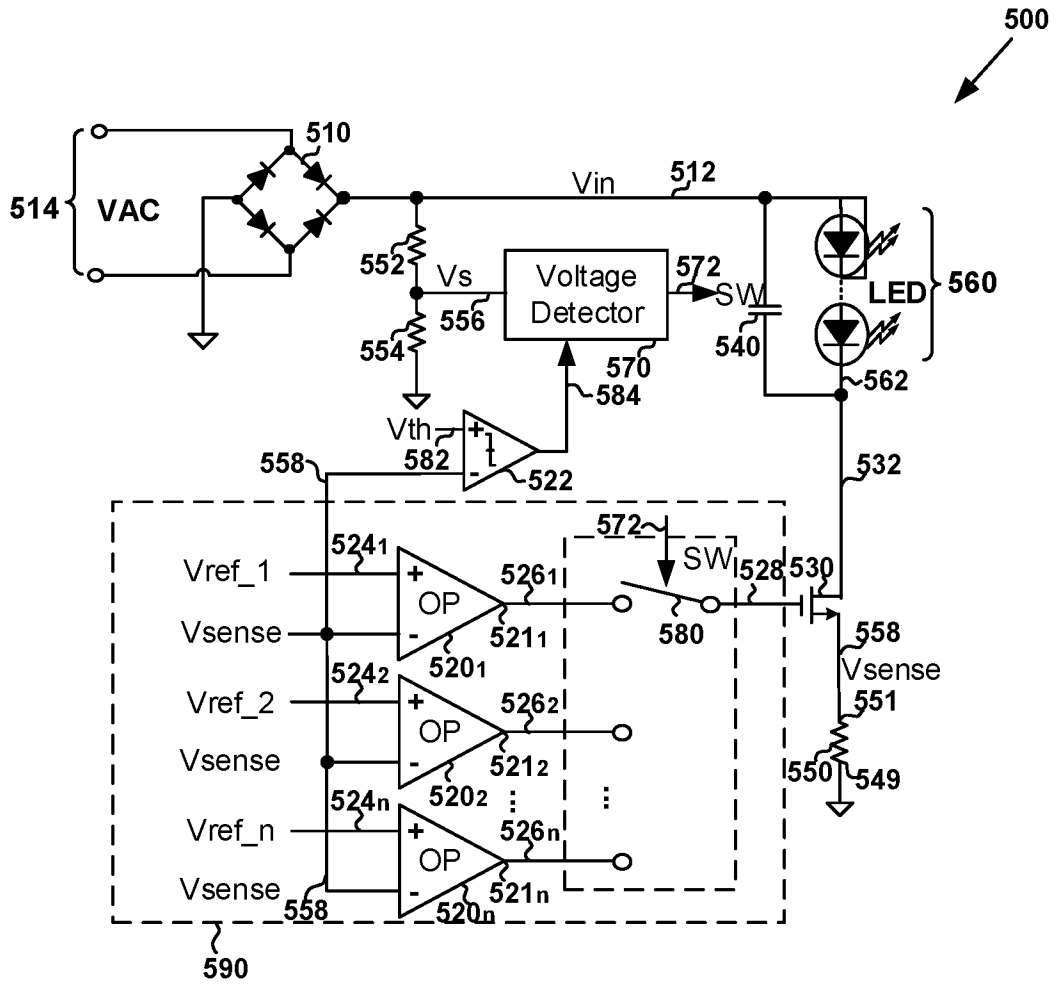
FIG. 5 is a simplified diagram showing an LED lighting system according to certain embodiments of the present invention.

FIG. 5 is a simplified diagram showing an LED lighting system according to certain embodiments of the present invention. This diagram is merely an example, which should not unduly limit the scope of the claims. One of ordinary skill in the art would recognize many variations, alternatives, and modifications. The LED lighting system 500 includes a bridge rectifier 510, a comparator 522, a transistor 530, a capacitor 540, resistors 550, 552 and 554, one or more light emitting diodes (LEDs) 560, a voltage detector 570, and a gate voltage controller 590. In certain examples, the gate voltage controller 590 includes a switch 580 and multiple operational amplifiers $\mathbf{520}_1$, $\mathbf{520}_2$, . . . , and $\mathbf{520}_n$, where n is a positive integer equal to or larger than 2. For example, the comparator 522, the transistor 530, the resistors 550, 552 and 554, the voltage detector 570, the switch 580, and the multiple operational amplifiers $\mathbf{520}_1$, $\mathbf{520}_2$, . . . , and $\mathbf{520}_n$ are used to perform segmented constant current control. In some examples, the transistor 530 is used to regulate a current 562 (e.g., $I_{LED}$) that flows through the one or more LEDs 560, and the resistor 550 is used to sense the current 562 (e.g., $I_{LED}$). Although the above has been shown using a selected group of components for the system, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

According to certain embodiments, after the LED lighting system 500 is powered on, an AC supply voltage 514 (e.g., VAC) is received by the bridge rectifier 510 (e.g., a full-wave rectifier), which generates an input voltage 512 (e.g., $V_{in}$). As an example, the input voltage 512 (e.g., $V_{in}$) is received by the resistor 552, the capacitor 540, and the one or more LEDs 560. In some examples, the resistors 552 and 554, as parts of a voltage divider, use the input voltage 512 (e.g., $V_{in}$) to generate a voltage 556 (e.g., $V_s$). For example, the voltage 556 (e.g., $V_s$) is directly proportional to the input voltage 512 (e.g., $V_{in}$). As an example, the voltage 556 (e.g., $V_s$) increases with the increasing input voltage 512 (e.g., $V_{in}$), and the voltage 556 (e.g., $V_s$) decreases with the decreasing input voltage 512 (e.g., $V_{in}$). In certain examples, the voltage 556 (e.g., $V_s$) is received by the voltage detector 570, which also receives a control signal 584 from the comparator 522. As an example, in response, the voltage detector 570 generates a control signal 572, which is received by the switch 580.

According to some embodiments, a gate voltage 528 is used to turn on the transistor 530, which also has a drain voltage 532 (e.g., $V_{drain}$). In certain examples, if the input voltage 512 (e.g., $V_{in}$) minus the drain voltage 532 (e.g., $V_{drain}$) becomes larger than the forward bias voltage of the one or more LEDs 560, the current 562 (e.g., $I_{LED}$) flows through the one or more LEDs 560, the transistor 530, and the resistor 550. As an example, in response, the resistor 550 generates a sensing voltage 558 (e.g., $V_{sense}$) that corresponds to the magnitude of the current 562 (e.g., $I_{LED}$). For example, the sensing voltage 558 (e.g., $V_{sense}$) is also the source voltage of the transistor 530. In some examples, the resistor 550 includes terminals 549 and 551. As an example, the terminal 549 is biased to a ground voltage, and the terminal 551 is connected to the source terminal of the transistor 530. For example, the resistor 550 generates the sensing voltage 558 (e.g., $V_{sense}$) at the terminal 551.

In certain embodiments, the multiple operational amplifiers $\mathbf{520}_1$, $\mathbf{520}_2$, . . . , and $\mathbf{520}_n$ receive corresponding multiple voltages $V_{ref_1}$, $V_{ref_2}$, . . . , and $V_{ref_n}$ respectively, where n is a positive integer equal to or larger than 2. For example, $V_{ref_j}$ is smaller than $V_{ref_i}$, if j is larger than i, where i is a positive integer smaller than n and j is a positive integer smaller than or equal to n. In some examples, each operational amplifier of the multiple operational amplifiers $\mathbf{520}_1$, $\mathbf{520}_2$, . . . , and $\mathbf{520}_n$ also receives the sensing voltage 558 (e.g., $V_{sense}$). For example, the multiple operational amplifiers $\mathbf{520}_1$, $\mathbf{520}_2$, . . . , and $\mathbf{520}_n$ generate corresponding multiple amplified signals $\mathbf{526}_1$, $\mathbf{526}_2$, . . . , and $\mathbf{526}_n$ respectively. As an example, the multiple operational amplifiers $\mathbf{520}_1$, $\mathbf{520}_2$, . . . , and $\mathbf{520}_n$ include corresponding multiple output terminals $\mathbf{521}_1$, $\mathbf{521}_2$, . . . , and $\mathbf{521}_n$ respectively, and generate the corresponding multiple amplified signals $\mathbf{526}_1$, $\mathbf{526}_2$, . . . , and $\mathbf{526}_n$ at the corresponding multiple output terminals $\mathbf{521}_1$, $\mathbf{521}_2$, . . . , and $\mathbf{521}_n$ respectively. In certain examples, the operational amplifier $\mathbf{520}_v$ receives the sensing voltage 558 (e.g., $V_{sense}$) and the reference voltage $V_{ref_v}$, compares the sensing voltage 558 (e.g., $V_{sense}$) and the reference voltage $V_{ref_v}$ (e.g., determines a difference between the sensing voltage 558 (e.g., $V_{sense}$) and the reference voltage $V_{ref_v}$), and generates the amplified signal $\mathbf{526}_v$, where v is a positive integer smaller than or equal to n.

In some embodiments, the switch 580 receives a control signal 572, selects one amplified signal from the multiple amplified signals $\mathbf{526}_1$, $\mathbf{526}_2$, . . . , and $\mathbf{526}_n$, and sends the selected amplified signal as the gate voltage 528 to the transistor 530. As an example, the selected amplified signal is received as the gate voltage 528 by the gate terminal of the transistor 530. In certain examples, the switch 580 receives the control signal 572 and the multiple amplified signals $\mathbf{526}_1$, $\mathbf{526}_2$, . . . , and $\mathbf{526}_n$, selects the amplified signal $\mathbf{526}_v$ from the multiple amplified signals $\mathbf{526}_1$, $\mathbf{526}_2$, . . . , and $\mathbf{526}_n$, and sends the amplified signal $\mathbf{526}_v$ as the gate voltage 528 to the transistor 530, where v is a positive integer smaller than or equal to n. As an example, the amplified signal $\mathbf{526}_v$ is generated by the operational amplifier $\mathbf{520}_v$, which receives the sensing voltage 558 (e.g., $V_{sense}$) and the reference voltage $V_{ref_v}$. In some examples, the gate voltage 528 is used to keep the current 562 at a constant magnitude. For example, the constant magnitude is determined by the reference voltage $V_{ref_v}$, which corresponds to the selected amplified signal $\mathbf{526}_v$.

According to certain embodiments, the voltage detector 570 receives the voltage 556 (e.g., $V_s$) and the control signal 584, and generates the control signal 572, which is received by the switch 580. In some examples, the switch 580 uses the control signal 572 to select the amplified signal $\mathbf{526}_v$ from the multiple amplified signals $\mathbf{526}_1$, $\mathbf{526}_2$, . . . , and $\mathbf{526}_n$ as the gate voltage 528 for the transistor 530. For example, the amplified signal $\mathbf{526}_v$ corresponds to the reference voltage $V_{ref_v}$. In certain examples, when the voltage 556 (e.g., $V_s$) increases, the reference voltage $V_{ref_v}$ that corresponds to the selected amplified signal $\mathbf{526}_v$ decreases by selecting higher integer value for v. As an example, $V_{ref_j}$ is smaller than $V_{ref_i}$, if j is larger than i, where i is a positive integer smaller than n and j is a positive integer smaller than or equal to n.

According to some embodiments, when the voltage 556 (e.g., $V_s$) increases, the constant magnitude of the current 562 decreases. For example, if the voltage 556 (e.g., $V_s$) is equal to a lower voltage magnitude, the reference voltage Vrer v that corresponds to the selected amplified signal $\mathbf{526}_v$ is larger and the current 562 is kept at a higher constant magnitude independent of time. As an example, if the voltage 556 (e.g., $V_s$) is equal to a higher voltage magnitude, the reference voltage $V_{ref_v}$ that corresponds to the selected amplified signal $\mathbf{526}_v$ is smaller and the current 562 is kept at a lower constant magnitude independent of time.

According to certain embodiments, if the input voltage 512 (e.g., $V_{in}$) is equal to a lower voltage magnitude, the current 562 is kept at a higher constant magnitude independent of time, and if the input voltage 512 (e.g., $V_{in}$) is equal to a higher voltage magnitude, the current 562 is kept at a lower constant magnitude independent of time. For example, as shown in Equations 1 and 2, reducing the constant magnitude of the current 562 when the input voltage 512 (e.g., $V_{in}$) increases can lower the power consumption of the transistor 530 (e.g., when the input voltage 512 (e.g., $V_{in}$) reaches its peak magnitude) and improve the energy efficiency of the LED lighting system 500.

In some embodiments, the voltage detector 570 is the same as the voltage detector 270 as shown in FIG. 3. For example, the control signal 572 as shown in FIG. 5 includes the comparison signals $\mathbf{372}_1$, $\mathbf{372}_2$, . . . , and $\mathbf{372}_{n-1}$ as shown in FIG. 3. In some examples, if each comparison signal of the comparison signals $\mathbf{372}_1$, $\mathbf{372}_2$, . . . , and $\mathbf{372}_{n-1}$ is at the logic high level, the amplified signal $\mathbf{526}_1$ is selected by the switch 580 as the gate voltage 528 for the transistor 530. In certain examples, if each comparison signal of the comparison signals $\mathbf{372}_1$, . . . $\mathbf{372}_{q-1}$ is at the logic low level, and each comparison signal of the comparison signals $\mathbf{372}_q$, $\mathbf{372}_{n-1}$ is at the logic high level, the amplified signal $\mathbf{526}_q$ is selected by the switch 580 as the gate voltage 528 for the transistor 530, where q is a positive integer larger than 2 and smaller than or equal to n−1. In some examples, if each comparison signal of the comparison signals $\mathbf{372}_1$, $\mathbf{372}_2$, . . . , and $\mathbf{372}_{n-1}$ is at the logic low level, the amplified signal $\mathbf{526}_n$ is selected by the switch 580 as the gate voltage 528 for the transistor 530. In certain embodiments, the comparator 522 receives the sensing voltage 558 (e.g., $V_{sense}$) and a threshold voltage 582 (e.g., $V_{th}$), compares the sensing voltage 558 (e.g., $V_{sense}$) and the threshold voltage 582 (e.g., $V_{th}$), and generate the control signal 584, which is received by the voltage detector 570.

As discussed above and further emphasized here, FIG. 5 is merely an example, which should not unduly limit the scope of the claims. One of ordinary skill in the art would recognize many variations, alternatives, and modifications. For example, if the switch 580 selects the amplified signal $\mathbf{526}_1$ from the multiple amplified signals $\mathbf{526}_1$, $\mathbf{526}_2$, . . . , and $\mathbf{526}_n$, and sends the amplified signal $\mathbf{526}_1$ as the gate voltage 528 to the transistor 530, the output terminal $\mathbf{521}_1$ of the operational amplifier $\mathbf{520}_1$ is connected to a terminal of a capacitor that includes another terminal biased to the ground voltage as shown in FIG. 6 according to some embodiments.

FIG. 6 is a simplified diagram showing certain modifications to the LED lighting system 200 as shown in FIG. 2 and/or the LED lighting system 500 as shown in FIG. 5 according to some embodiments of the present invention. This diagram is merely an example, which should not unduly limit the scope of the claims. One of ordinary skill in the art would recognize many variations, alternatives, and modifications. The LED lighting system 600 includes a bridge rectifier 610, a comparator 622, a transistor 630, a capacitor 640, resistors 650, 652 and 654, one or more light emitting diodes (LEDs) 660, a voltage detector 670, and a gate voltage controller 690. In certain examples, the gate voltage controller 690 includes an operational amplifier 620 and a capacitor 604. In some examples, the operational amplifier 620 includes an output terminal 621, and the capacitor 604 includes terminals 606 and 608. As an example, the output terminal 621 is connected to the terminal 606 of the capacitor 604, and the terminal 608 is biased to a ground voltage. For example, the transistor 630 is used to regulate a current 662 (e.g., $I_{LED}$) that flows through the one or more LEDs 660, and the resistor 650 is used to sense the current 662 (e.g., $I_{LED}$). Although the above has been shown using a selected group of components for the system, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

According to certain embodiments, the LED lighting system 600 includes certain modifications to the LED lighting system 200. In some examples, the bridge rectifier 610 is the same as the bridge rectifier 210, the comparator 622 is the same as the comparator 222, the transistor 630 is the same as the transistor 230, the capacitor 640 is the same as the capacitor 240, the resistors 650, 652 and 654 are the same as the resistors 250, 252 and 254 respectively, the one or more LEDs 660 are the same as the one or more LEDs 260, and the voltage detector 670 is the same as the voltage detector 270. In certain examples, the gate voltage controller 690 is different from the gate voltage controller 290 by at least adding the capacitor 604. For example, the operational amplifier 620 is the same as the operational amplifier 220. As an example, with certain modifications as shown in FIG. 6, if $V_{ref_1}$ is selected from the multiple voltages $V_{ref_1}$, $V_{ref_2}$, . . . , and $V_{ref_n}$, and is sent as the reference voltage to the operational amplifier 220, the output terminal 221 of the operational amplifier 220 is connected to the terminal 606 of the capacitor 604 that also includes the terminal 608 biased to the ground voltage as shown in FIG. 6.

According to some embodiments, the LED lighting system 600 includes certain modifications to the LED lighting system 500. In some examples, the bridge rectifier 610 is the same as the bridge rectifier 510, the comparator 622 is the same as the comparator 522, the transistor 630 is the same as the transistor 530, the capacitor 640 is the same as the capacitor 540, the resistors 650, 652 and 654 are the same as the resistors 550, 552 and 554 respectively, the one or more LEDs 660 are the same as the one or more LEDs 560, and the voltage detector 670 is the same as the voltage detector 570. In certain examples, the gate voltage controller 690 is different from the gate voltage controller 590 by at least adding the capacitor 604. For example, the operational amplifier 620 is the same as the operational amplifier $\mathbf{520}_1$. As an example, with certain modifications as shown in FIG. 6, if the amplified signal $\mathbf{526}_1$ that is generated by the operational amplifier $\mathbf{520}_1$ is selected from the multiple amplified signals $\mathbf{526}_1$, $\mathbf{526}_2$, . . . , and $\mathbf{526}_n$, and is sent as the gate voltage to the transistor 530, the output terminal $\mathbf{521}_1$ of the operational amplifier $\mathbf{520}_1$ is connected to the terminal 606 of the capacitor 604 that also includes the terminal 608 biased to the ground voltage as shown in FIG. 6.

As shown in FIG. 6, the capacitor 604 is used as a compensation capacitor according to certain embodiments. In some examples, the capacitor 604, the operational amplifier 620, the transistor 630, and the resistor 650 are parts of a current control loop. In certain examples, the current control loop makes the current (e.g., the current 262 and/or the current 562) more stable in magnitude. As an example, the current control loop makes the current (e.g., the current 262 and/or the current 562) less dependent on the change in the input voltage (e.g., the input voltage 212 and/or the input voltage 512). For example, the current control loop makes the current (e.g., the current 262 and/or the current 562) less dependent on the change in the voltage drop across the one or more LEDs 660.

As discussed above and further emphasized here, FIG. 6 is merely an example, which should not unduly limit the scope of the claims. One of ordinary skill in the art would recognize many variations, alternatives, and modifications. As an example, the LED lighting system 600 is implemented according to at least FIG. 7. For example, the LED lighting system 600 is implemented according to at least FIG. 8. As an example, the LED lighting system 600 is implemented according to at least FIG. 9.

Figure 7:
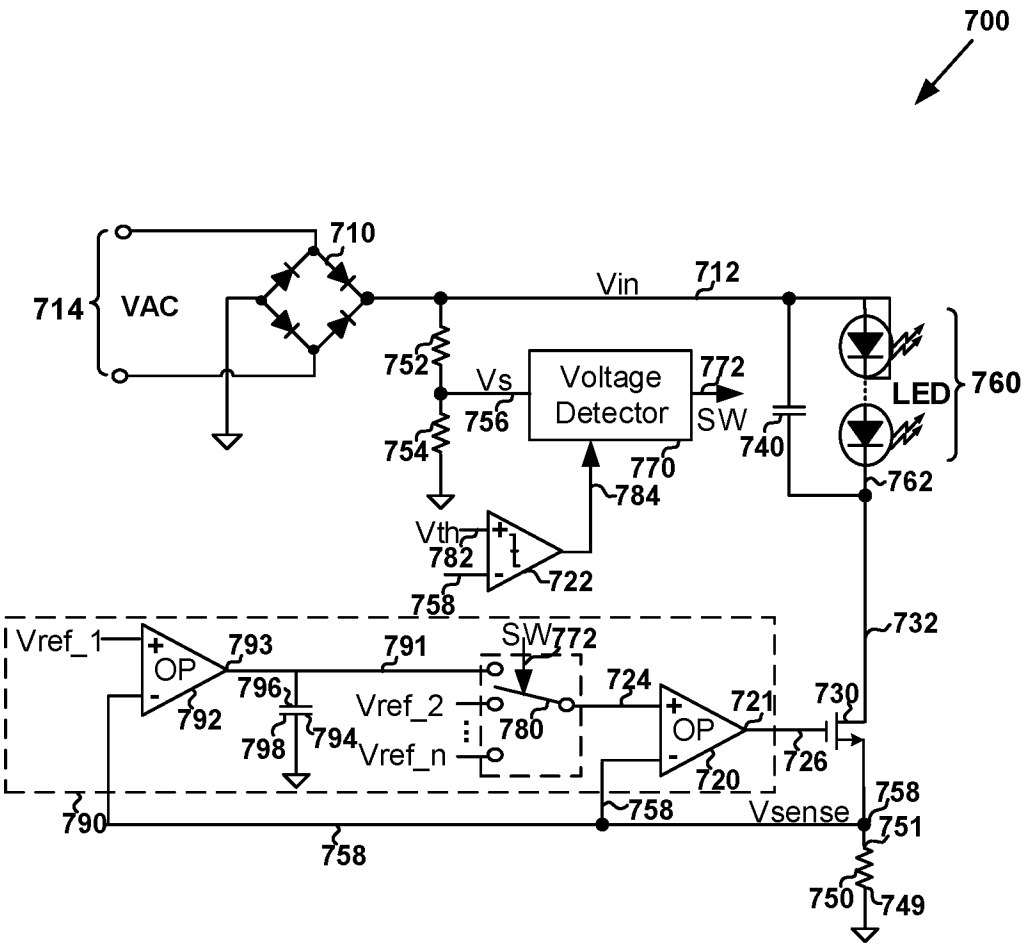
FIG. 7 is a simplified diagram showing an LED lighting system according to certain embodiments of the present invention.

FIG. 7 is a simplified diagram showing an LED lighting system according to certain embodiments of the present invention. This diagram is merely an example, which should not unduly limit the scope of the claims. One of ordinary skill in the art would recognize many variations, alternatives, and modifications. The LED lighting system 700 includes a bridge rectifier 710, a comparator 722, a transistor 730, a capacitor 740, resistors 750, 752 and 754, one or more light emitting diodes (LEDs) 760, a voltage detector 770, and a gate voltage controller 790. In certain examples, the gate voltage controller 790 includes operational amplifiers 720 and 792, a switch 780, and a capacitor 794. For example, the operational amplifiers 720 and 792, the comparator 722, the transistor 730, the resistors 750, 752 and 754, the voltage detector 770, the switch 780, and the capacitor 794 are used to perform segmented constant current control. In some examples, the transistor 730 is used to regulate a current 762 (e.g., $I_{LED}$) that flows through the one or more LEDs 760, and the resistor 750 is used to sense the current 762 (e.g., $I_{LED}$). Although the above has been shown using a selected group of components for the system, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

According to certain embodiments, after the LED lighting system 700 is powered on, an AC supply voltage 714 (e.g., VAC) is received by the bridge rectifier 710 (e.g., a full-wave rectifier), which generates an input voltage 712 (e.g., $V_{in}$). As an example, the input voltage 712 (e.g., $V_{in}$) is received by the resistor 752, the capacitor 740, and the one or more LEDs 760. In some examples, the resistors 752 and 754, as parts of a voltage divider, use the input voltage 712 (e.g., $V_{in}$) to generate a voltage 756 (e.g., $V_s$). For example, the voltage 756 (e.g., $V_s$) is directly proportional to the input voltage 712 (e.g., $V_{in}$). As an example, the voltage 756 (e.g., $V_s$) increases with the increasing input voltage 712 (e.g., $V_{in}$), and the voltage 756 (e.g., $V_s$) decreases with the decreasing input voltage 712 (e.g., $V_{in}$). In certain examples, the voltage 756 (e.g., $V_s$) is received by the voltage detector 770, which also receives a control signal 784 from the comparator 722. As an example, in response, the voltage detector 770 generates a control signal 772, which is received by the switch 780.

According to some embodiments, the operational amplifier 720 generates a gate voltage 726 to turn on the transistor 730, which also has a drain voltage 732 (e.g., $V_{drain}$). For example, the operational amplifier 720 includes an output terminal 721 and generates the gate voltage 726 at the output terminal 721, and the gate voltage 726 is received by the gate terminal of the transistor 730. In some examples, if the input voltage 712 (e.g., $V_{in}$) minus the drain voltage 732 (e.g., Varain) becomes larger than the forward bias voltage of the one or more LEDs 760, the current 762 (e.g., $I_{LED}$) flows through the one or more LEDs 760, the transistor 730, and the resistor 750. As an example, in response, the resistor 750 generates a sensing voltage 758 (e.g., $V_{sense}$) that corresponds to the magnitude of the current 762 (e.g., $I_{LED}$). For example, the sensing voltage 758 (e.g., $V_{sense}$) is also the source voltage of the transistor 730. In certain examples, the resistor 750 includes terminals 749 and 751. As an example, the terminal 749 is biased to a ground voltage, and the terminal 751 is connected to the source terminal of the transistor 730. For example, the resistor 750 generates the sensing voltage 758 (e.g., $V_{sense}$) at the terminal 751.

In certain embodiments, the operational amplifier 792 includes an output terminal 793, and the output terminal 793 is connected to a terminal 796 of the capacitor 794. For example, the capacitor 794 (e.g., a compensation capacitor) also includes a terminal 798, which is biased to the ground voltage. As an example, the operational amplifier 792 receives a voltage $V_{ref_1}$ and the sensing voltage 758, compares the voltage $V_{ref_1}$ and the sensing voltage 758 (e.g., determines a difference between the voltage $V_{ref_1}$ and the sensing voltage 758), and generates a voltage 791 at the output terminal 793. In some embodiments, the switch 780 receives the control signal 772, selects one voltage from multiple voltages, and sends the selected voltage as a reference voltage 724 (e.g., $V_{ref}$) to the operational amplifier 720. In certain examples, the multiple voltages include the voltage 791 and voltages $V_{ref_2}$, . . . , and $V_{ref_n}$, where n is a positive integer equal to or larger than 2. In some examples, for the voltages $V_{ref_1}$, $V_{ref_2}$, . . . , and $V_{ref_n}$, $V_{ref_j}$ is smaller than $V_{ref_i}$, if j is larger than i, where i is a positive integer smaller than n and j is a positive integer smaller than or equal to n.

According to certain embodiments, when the voltage 756 (e.g., $V_s$) increases, the selected voltage used as the reference voltage 724 (e.g., $V_{ref}$) decreases in magnitude. As an example, if the voltage 756 (e.g., $V_s$) is smaller than a first threshold, the voltage 791 that corresponds to the voltage $V_{ref_1}$ is selected as the reference voltage 724. For example, if the voltage 756 (e.g., $V_s$) is larger than the first threshold but smaller than a second threshold, the voltage $V_{ref_2}$ is selected as the reference voltage 724.

According to some embodiments, the operational amplifier 720 receives the sensing voltage 758 (e.g., $V_{sense}$) and the reference voltage 724 (e.g., $V_{ref}$), compares the voltages 724 and 758 (e.g., determines a difference between the voltages 724 and 758), and adjusts the gate voltage 726 to keep the current 762 at a constant magnitude. For example, the gate voltage 726 is used to determine the constant magnitude of the current 762. According to some embodiments, the comparator 722 receives the sensing voltage 758 (e.g., $V_{sense}$) and a threshold voltage 782 (e.g., $V_{th}$), compares the sensing voltage 758 (e.g., $V_{sense}$) and the threshold voltage 782 (e.g., $V_{th}$), and generate the control signal 784, which is received by the voltage detector 770.

In certain embodiments, the voltage detector 770 is the same as the voltage detector 270 as shown in FIG. 3. For example, the control signal 772 as shown in FIG. 7 includes the comparison signals $\mathbf{372}_1$, $\mathbf{372}_2$, . . . , and $\mathbf{372}_{n-1}$ as shown in FIG. 3. In some examples, if each comparison signal of the comparison signals $\mathbf{372}_1$, $\mathbf{372}_2$, . . . , and $\mathbf{372}_{n-1}$ is at the logic high level, the voltage 791 is selected by the switch 780 as the reference voltage 724 (e.g., $V_{ref}$) for the operational amplifier 720. In certain examples, if each comparison signal of the comparison signals $\mathbf{372}_1$, . . . $\mathbf{372}_{q-1}$ is at the logic low level, and each comparison signal of the comparison signals $\mathbf{372}_q$, $\mathbf{372}_{n-1}$ is at the logic high level, the voltage $V_{ref_q}$ is selected by the switch 780 as the reference voltage 724 (e.g., $V_{ref}$) for the operational amplifier 720, where q is a positive integer larger than 2 and smaller than or equal to n−1. In some examples, if each comparison signal of the comparison signals $\mathbf{372}_1$, $\mathbf{372}_2$, . . . , and $\mathbf{372}_{n-1}$ is at the logic low level, the voltage $V_{ref_n}$ is selected by the switch 780 as the reference voltage 724 (e.g., $V_{ref}$) for the operational amplifier 720.

In some embodiments, if the input voltage 712 (e.g., $V_{in}$) is equal to a lower voltage magnitude, the current 762 is kept at a higher constant magnitude independent of time, and if the input voltage 712 (e.g., $V_{in}$) is equal to a higher voltage magnitude, the current 762 is kept at a lower constant magnitude independent of time. For example, as shown in Equations 1 and 2, reducing the constant magnitude of the current 762 when the input voltage 712 (e.g., $V_{in}$) increases can lower the power consumption of the transistor 730 (e.g., when the input voltage 712 (e.g., $V_{in}$) reaches its peak magnitude) and improve the energy efficiency of the LED lighting system 700.

Figure 8:
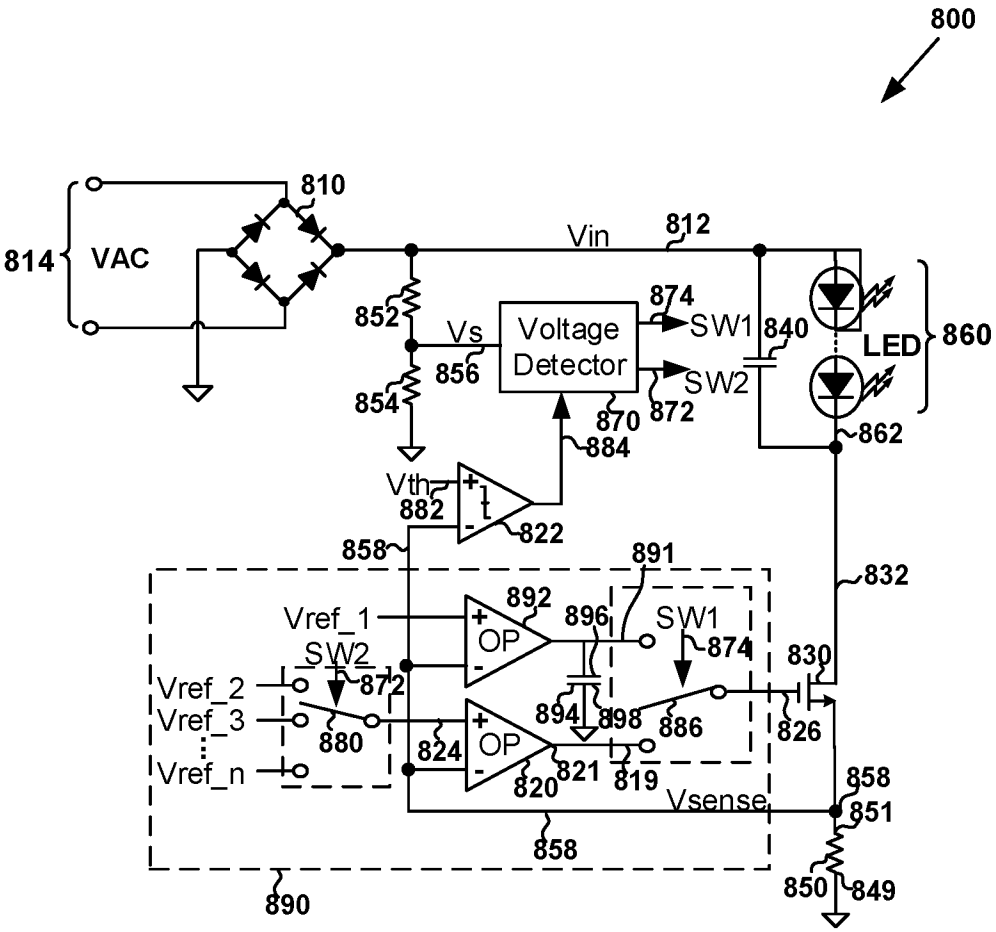
FIG. 8 is a simplified diagram showing an LED lighting system according to some embodiments of the present invention.

FIG. 8 is a simplified diagram showing an LED lighting system according to some embodiments of the present invention. This diagram is merely an example, which should not unduly limit the scope of the claims. One of ordinary skill in the art would recognize many variations, alternatives, and modifications. The LED lighting system 800 includes a bridge rectifier 810, a comparator 822, a transistor 830, a capacitor 840, resistors 850, 852 and 854, one or more light emitting diodes (LEDs) 860, a voltage detector 870, and a gate voltage controller 890. In certain examples, the gate voltage controller 890 includes operational amplifiers 820 and 892, switches 880 and 886, and a capacitor 894. For example, the operational amplifiers 820 and 892, the comparator 822, the transistor 830, the resistors 850, 852 and 854, the voltage detector 870, the switches 880 and 886, and the capacitor 894 are used to perform segmented constant current control. In some examples, the transistor 830 is used to regulate a current 862 (e.g., $I_{LED}$) that flows through the one or more LEDs 860, and the resistor 850 is used to sense the current 862 (e.g., $I_{LED}$). Although the above has been shown using a selected group of components for the system, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

According to certain embodiments, after the LED lighting system 800 is powered on, an AC supply voltage 814 (e.g., VAC) is received by the bridge rectifier 810 (e.g., a full-wave rectifier), which generates an input voltage 812 (e.g., $V_{in}$). As an example, the input voltage 812 (e.g., $V_{in}$) is received by the resistor 852, the capacitor 840, and the one or more LEDs 860. In some examples, the resistors 852 and 854, as parts of a voltage divider, use the input voltage 812 (e.g., $V_{in}$) to generate a voltage 856 (e.g., $V_s$). For example, the voltage 856 (e.g., $V_s$) is directly proportional to the input voltage 812 (e.g., $V_{in}$). As an example, the voltage 856 (e.g., $V_s$) increases with the increasing input voltage 812 (e.g., $V_{in}$), and the voltage 856 (e.g., $V_s$) decreases with the decreasing input voltage 812 (e.g., $V_{in}$). In certain examples, the voltage 856 (e.g., $V_s$) is received by the voltage detector 870, which also receives a control signal 884 from the comparator 822. As an example, in response, the voltage detector 870 generates a control signal 872 that is received by the switch 880, and the voltage detection 870 also generates a control signal 874 that is received by the switch 886.

According to some embodiments, a gate voltage 826 is used to turn on the transistor 830, which also has a drain voltage 832 (e.g., $V_{drain}$). In certain examples, if the input voltage 812 (e.g., $V_{in}$) minus the drain voltage 832 (e.g., $V_{drain}$) becomes larger than the forward bias voltage of the one or more LEDs 860, the current 862 (e.g., $I_{LED}$) flows through the one or more LEDs 860, the transistor 830, and the resistor 850. As an example, in response, the resistor 850 generates a sensing voltage 858 (e.g., $V_{sense}$) that corresponds to the magnitude of the current 862 (e.g., $I_{LED}$). For example, the sensing voltage 858 (e.g., $V_{sense}$) is also the source voltage of the transistor 830. In certain examples, the resistor 850 includes terminals 849 and 851. As an example, the terminal 849 is biased to a ground voltage, and the terminal 851 is connected to the source terminal of the transistor 830. For example, the resistor 850 generates the sensing voltage 858 (e.g., $V_{sense}$) at the terminal 851.

In some embodiments, the switch 880 receives the control signal 782, selects one voltage from multiple voltages, and sends the selected voltage as a reference voltage 824 (e.g., $V_{ref}$) to the operational amplifier 820. In certain examples, the multiple voltages include voltages $V_{ref_2}$, . . . , and $V_{ref_n}$, where n is a positive integer equal to or larger than 2. In some examples, the operational amplifier 820 receives the sensing voltage 858 (e.g., $V_{sense}$) and the reference voltage 824 (e.g., $V_{ref}$), compares the voltages 824 and 858 (e.g., determines a difference between the voltages 824 and 858), and generates a voltage 819. For example, the operational amplifier 820 includes an output terminal 821, and generates the voltage 819 at the output terminal 821.

In certain embodiments, the operational amplifier 892 includes an output terminal 893, and the output terminal 893 is connected to a terminal 896 of the capacitor 894. For example, the capacitor 894 (e.g., a compensation capacitor) also includes a terminal 898, which is biased to the ground voltage. As an example, the operational amplifier 892 receives a voltage $V_{ref_1}$ and the sensing voltage 858, compares the voltage $V_{ref_1}$ and the sensing voltage 858 (e.g., determines a difference between the voltage $V_{ref_1}$ and the sensing voltage 858), and generates a voltage 891 at the output terminal 893. In some examples, for the voltages $V_{ref_1}$, $V_{ref_2}$, . . . , and $V_{ref_n}$, $V_{ref_j}$ is smaller than $V_{ref_i}$, if j is larger than i, where i is a positive integer smaller than n and j is a positive integer smaller than or equal to n.

According to some embodiments, the switch 886 receives the control signal 874, selects the voltage 891 or the voltage 819 as the gate voltage 826, and sends the gate voltage 826 to the transistor 830. In certain examples, the gate voltage 826 is received by the gate terminal of the transistor 830 to keep the current 862 at a constant magnitude. For example, the gate voltage 826 is used to determine the constant magnitude of the current 862. According to certain embodiments, the comparator 822 receives the sensing voltage 858 (e.g., $V_{sense}$) and a threshold voltage 882 (e.g., $V_{th}$), compares the sensing voltage 858 (e.g., $V_{sense}$) and the threshold voltage 882 (e.g., $V_{th}$), and generate the control signal 884, which is received by the voltage detector 870.

In certain embodiments, when the voltage 856 (e.g., $V_s$) increases, the selected voltage used as the reference voltage 824 (e.g., $V_{ref}$) decreases in magnitude. As an example, if the voltage 856 (e.g., $V_s$) is smaller than a first threshold, the voltage 891 that corresponds to the voltage $V_{ref_1}$ is selected as the gate voltage 826. For example, if the voltage 856 (e.g., $V_s$) is larger than the first threshold but smaller than a second threshold, the voltage $V_{ref_2}$ is selected as the reference voltage 824, and the voltage 819 is selected as the gate voltage 826.

In some embodiments, the voltage detector 870 is the same as the voltage detector 270 as shown in FIG. 3, except that the control signal 872 as shown in FIG. 8 includes the comparison signals $\mathbf{372}_2$, . . . , and $\mathbf{372}_{n-1}$ as shown in FIG. 3 and the control signal 874 as shown in FIG. 8 includes the comparison signal $\mathbf{372}_1$ as shown in FIG. 3. In certain examples, if each comparison signal of the comparison signals $\mathbf{372}_1$, $\mathbf{372}_2$, . . . , and $\mathbf{372}_{n-1}$ is at the logic high level, the voltage 891 is selected by the switch 886 as the gate voltage 826 for the transistor 830. In some examples, if each comparison signal of the comparison signals $\mathbf{372}_1$, . . . $\mathbf{372}_{q-1}$ is at the logic low level, and each comparison signal of the comparison signals $\mathbf{372}_q$, . . . $\mathbf{372}_{n-1}$ is at the logic high level, the voltage $V_{ref_q}$ is selected by the switch 880 as the reference voltage 824 (e.g., $V_{ref}$) for the operational amplifier 820 and the voltage 819 is selected by the switch 886 as the gate voltage 826 for the transistor 830, where q is a positive integer larger than 2 and smaller than or equal to n−1. In certain examples, if each comparison signal of the comparison signals $\mathbf{372}_1$, $\mathbf{372}_2$, . . . , and $\mathbf{372}_{n-1}$ is at the logic low level, the voltage $V_{ref_n}$ is selected by the switch 880 as the reference voltage 824 (e.g., $V_{ref}$) for the operational amplifier 820 and the voltage 819 is selected by the switch 886 as the gate voltage 826 for the transistor 830.

According to certain embodiments, if the input voltage 812 (e.g., $V_{in}$) is equal to a lower voltage magnitude, the current 862 is kept at a higher constant magnitude independent of time, and if the input voltage 812 (e.g., $V_{in}$) is equal to a higher voltage magnitude, the current 862 is kept at a lower constant magnitude independent of time. For example, as shown in Equations 1 and 2, reducing the constant magnitude of the current 862 when the input voltage 812 (e.g., $V_{in}$) increases can lower the power consumption of the transistor 830 (e.g., when the input voltage 812 (e.g., $V_{in}$) reaches its peak magnitude) and improve the energy efficiency of the LED lighting system 800.

Figure 9:
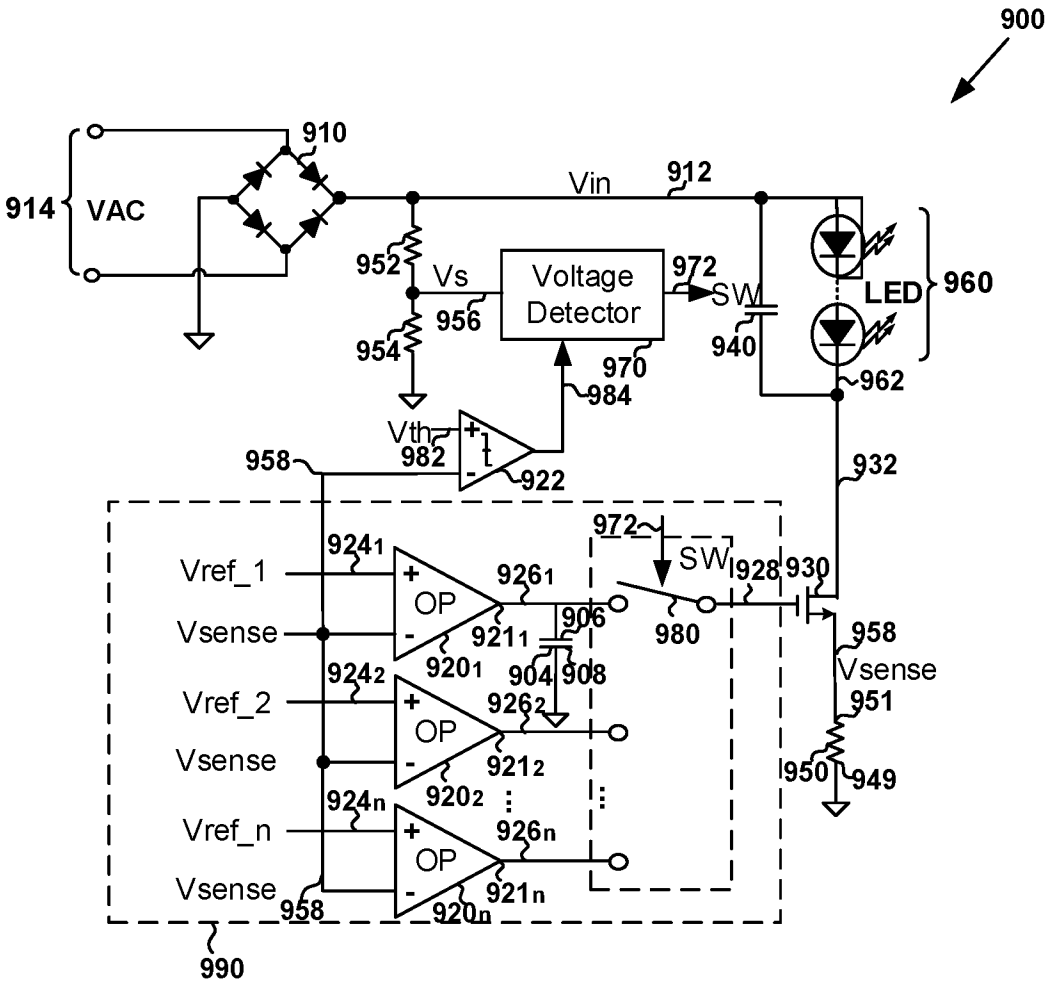
FIG. 9 is a simplified diagram showing an LED lighting system according to certain embodiments of the present invention.

FIG. 9 is a simplified diagram showing an LED lighting system according to certain embodiments of the present invention. This diagram is merely an example, which should not unduly limit the scope of the claims. One of ordinary skill in the art would recognize many variations, alternatives, and modifications. The LED lighting system 900 includes a bridge rectifier 910, a comparator 922, a transistor 930, a capacitor 940, resistors 950, 952 and 954, one or more light emitting diodes (LEDs) 960, a voltage detector 970, and a gate voltage controller 990. In certain examples, the gate voltage controller 990 includes a switch 980, a capacitor 904, and multiple operational amplifiers $\mathbf{920}_1$, $\mathbf{920}_2$, . . . , and $\mathbf{920}_n$, where n is a positive integer equal to or larger than 2. For example, the comparator 922, the transistor 930, the resistors 950, 952 and 954, the voltage detector 970, the switch 980, and the capacitor 904, and the multiple operational amplifiers $\mathbf{920}_1$, $\mathbf{920}_2$, . . . , and $\mathbf{920}_n$ are used to perform segmented constant current control. In some examples, the transistor 930 is used to regulate a current 962 (e.g., $I_{LED}$) that flows through the one or more LEDs 960, and the resistor 950 is used to sense the current 962 (e.g., $I_{LED}$). Although the above has been shown using a selected group of components for the system, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

According to certain embodiments, after the LED lighting system 900 is powered on, an AC supply voltage 914 (e.g., VAC) is received by the bridge rectifier 910 (e.g., a full-wave rectifier), which generates an input voltage 912 (e.g., $V_{in}$). As an example, the input voltage 912 (e.g., $V_{in}$) is received by the resistor 952, the capacitor 940, and the one or more LEDs 960. In some examples, the resistors 952 and 954, as parts of a voltage divider, use the input voltage 912 (e.g., $V_{in}$) to generate a voltage 956 (e.g., $V_s$). For example, the voltage 956 (e.g., $V_s$) is directly proportional to the input voltage 912 (e.g., $V_{in}$). As an example, the voltage 956 (e.g., $V_s$) increases with the increasing input voltage 912 (e.g., $V_{in}$), and the voltage 956 (e.g., $V_s$) decreases with the decreasing input voltage 912 (e.g., $V_{in}$). In certain examples, the voltage 956 (e.g., $V_s$) is received by the voltage detector 970, which also receives a control signal 984 from the comparator 922. As an example, in response, the voltage detector 970 generates a control signal 972, which is received by the switch 980.

According to some embodiments, a gate voltage 928 is used to turn on the transistor 930, which also has a drain voltage 932 (e.g., $V_{drain}$). In certain examples, if the input voltage 912 (e.g., $V_{in}$) minus the drain voltage 932 (e.g., $V_{drain}$) becomes larger than the forward bias voltage of the one or more LEDs 960, the current 962 (e.g., $I_{LED}$) flows through the one or more LEDs 960, the transistor 930, and the resistor 950. As an example, in response, the resistor 950 generates a sensing voltage 958 (e.g., $V_{sense}$) that corresponds to the magnitude of the current 962 (e.g., $I_{LED}$). For example, the sensing voltage 958 (e.g., $V_{sense}$) is also the source voltage of the transistor 930. In some examples, the resistor 950 includes terminals 949 and 951. As an example, the terminal 949 is biased to a ground voltage, and the terminal 951 is connected to the source terminal of the transistor 930. For example, the resistor 950 generates the sensing voltage 958 (e.g., $V_{sense}$) at the terminal 951.

In certain embodiments, the multiple operational amplifiers $\mathbf{920}_1$, $\mathbf{920}_2$, . . . , and $\mathbf{920}_n$ receive corresponding multiple voltages $V_{ref_1}$, $V_{ref_2}$, . . . , and $V_{ref_n}$ respectively, where n is a positive integer equal to or larger than 2. For example, $V_{ref_j}$ is smaller than $V_{ref_i}$, if j is larger than i, where i is a positive integer smaller than n and j is a positive integer smaller than or equal to n. In some examples, each operational amplifier of the multiple operational amplifiers 520$_1$, 520$_2$, . . . , and 520$_n$ also receives the sensing voltage 958 (e.g., $V_{sense}$). For example, the multiple operational amplifiers 920$_1$, 920$_2$, . . . , and 920$_n$ generate corresponding multiple amplified signals 926$_1$, 926$_2$, . . . , and 926$_n$ respectively. As an example, the multiple operational amplifiers 920$_1$, 920$_2$, . . . , and 920$_n$ include corresponding multiple output terminals 921$_1$, 921$_2$, . . . , and 921$_n$ respectively, and generate the corresponding multiple amplified signals 926$_1$, 926$_2$, . . . , and 926$_n$ at the corresponding multiple output terminals 921$_1$, 921$_2$, . . . , and 921$_n$ respectively.

In certain examples, the capacitor 904 (e.g., a compensation capacitor) includes terminals 906 and 908. As an example, the output terminal 921$_1$ of the operational amplifiers 920$_1$ is connected to the terminal 906 of the capacitor 904, and the terminal 908 is biased to the ground voltage. In some examples, the operational amplifier 920$_v$ receives the sensing voltage 958 (e.g., $V_{sense}$) and the reference voltage $V_{ref_v}$, compares the sensing voltage 958 (e.g., $V_{sense}$) and the reference voltage $V_{ref_v}$(e.g., determines a difference between the sensing voltage 958 (e.g., $V_{sense}$) and the reference voltage $V_{ref_v}$), and generates the amplified signals 926$_v$, where v is a positive integer smaller than or equal to n.

In some embodiments, the switch 980 receives a control signal 972, selects one amplified signal from the multiple amplified signals 926$_1$, 926$_2$, . . . , and 926$_n$, and sends the selected amplified signal as the gate voltage 928 to the transistor 930. As an example, the selected amplified signal is received as the gate voltage 928 by the gate terminal of the transistor 930. In certain examples, the switch 980 receives the control signal 972 and the multiple amplified signals 926$_1$, 926$_2$, . . . , and 926$_n$, selects the amplified signal 926, from the multiple amplified signals 926$_1$, 926$_2$, . . . , and 926$_n$, and sends the amplified signal 926, as the gate voltage 928 to the transistor 930, where v is a positive integer smaller than or equal to n. As an example, the amplified signal 926$_v$ is generated by the operational amplifier 920$_v$, which receives the sensing voltage 958 (e.g., $V_{sense}$) and the reference voltage $V_{ref_v}$. In some examples, the gate voltage 928 is used to keep the current 962 at a constant magnitude. For example, the constant magnitude is determined by the reference voltage $V_{ref_v}$, which corresponds to the selected amplified signal 926$_v$.

According to certain embodiments, the voltage detector 970 receives the voltage 956 (e.g., $V_s$) and the control signal 984, and generates the control signal 972, which is received by the switch 980. In some examples, the switch 980 uses the control signal 972 to select the amplified signal 926$_v$ from the multiple amplified signals 926$_1$, 926$_2$, . . . , and 926$_n$ as the gate voltage 928 for the transistor 930. For example, the amplified signal 926$_v$ corresponds to the reference voltage $V_{ref_v}$. In certain examples, when the voltage 956 (e.g., $V_s$) increases, the reference voltage $V_{ref_v}$ that corresponds to the selected amplified signal 926$_v$ decreases by selecting higher integer value for v. As an example, $V_{ref_j}$ is smaller than $V_{ref_i}$, if j is larger than i, where i is a positive integer smaller than n and j is a positive integer smaller than or equal to n.

According to some embodiments, when the voltage 956 (e.g., $V_s$) increases, the constant magnitude of the current 962 decreases. For example, if the voltage 956 (e.g., $V_s$) is equal to a lower voltage magnitude, the reference voltage $V_{ref_v}$ that corresponds to the selected amplified signal 926$_v$ is larger and the current 962 is kept at a higher constant magnitude independent of time. As an example, if the voltage 956 (e.g., $V_s$) is equal to a higher voltage magnitude, the reference voltage $V_{ref_v}$ that corresponds to the selected amplified signal 926$_v$ is smaller and the current 962 is kept at a lower constant magnitude independent of time.

According to certain embodiments, if the input voltage 912 (e.g., $V_{in}$) is equal to a lower voltage magnitude, the current 962 is kept at a higher constant magnitude independent of time, and if the input voltage 912 (e.g., $V_{in}$) is equal to a higher voltage magnitude, the current 962 is kept at a lower constant magnitude independent of time. For example, as shown in Equations 1 and 2, reducing the constant magnitude of the current 962 when the input voltage 912 (e.g., $V_{in}$) increases can lower the power consumption of the transistor 930 (e.g., when the input voltage 912 (e.g., $V_{in}$) reaches its peak magnitude) and improve the energy efficiency of the LED lighting system 900.

In some embodiments, the voltage detector 970 is the same as the voltage detector 270 as shown in FIG. 3. For example, the control signal 972 as shown in FIG. 9 includes the comparison signals 372$_1$, 372$_2$, . . . , and 372$_{n-1}$ as shown in FIG. 3. In some examples, if each comparison signal of the comparison signals 372$_1$, 372$_2$, . . . , and 372$_{n-1}$ is at the logic high level, the amplified signal 926$_1$ is selected by the switch 980 as the gate voltage 928 for the transistor 930. In certain examples, if each comparison signal of the comparison signals 372$_1$, . . . 372$_{q-1}$ is at the logic low level, and each comparison signal of the comparison signals 372$_q$, . . . 372$_{n-1}$ is at the logic high level, the amplified signal 926$_q$ is selected by the switch 980 as the gate voltage 928 for the transistor 930, where q is a positive integer larger than 2 and smaller than or equal to n−1. In some examples, if each comparison signal of the comparison signals 372$_1$, 372$_2$, . . . , and 372$_{n-1}$ is at the logic low level, the amplified signal 926, is selected by the switch 980 as the gate voltage 928 for the transistor 930. In certain embodiments, the comparator 922 receives the sensing voltage 958 (e.g., $V_{sense}$) and a threshold voltage 982 (e.g., $V_{th}$), compares the sensing voltage 958 (e.g., $V_{sense}$) and the threshold voltage 982 (e.g., $V_{th}$), and generate the control signal 984, which is received by the voltage detector 970.

As shown in FIG. 7, FIG. 8, and/or FIG. 9, the LED lighting system (e.g., the LED lighting system 700, the LED lighting system 800, and/or the LED lighting system 900) is configured to regulate the average of the current that flows through the one or more LEDs (e.g., to regulate the average of the current 762 that flows through the one or more LEDs 760, to regulate the average of the current 862 that flows through the one or more LEDs 860, and/or to regulate the average of the current 962 that flows through the one or more LEDs 960) according to certain embodiments. For example, the capacitor 794, the capacitor 894, and/or the capacitor 904 is configured to perform the operation of integration.

Figure 10:
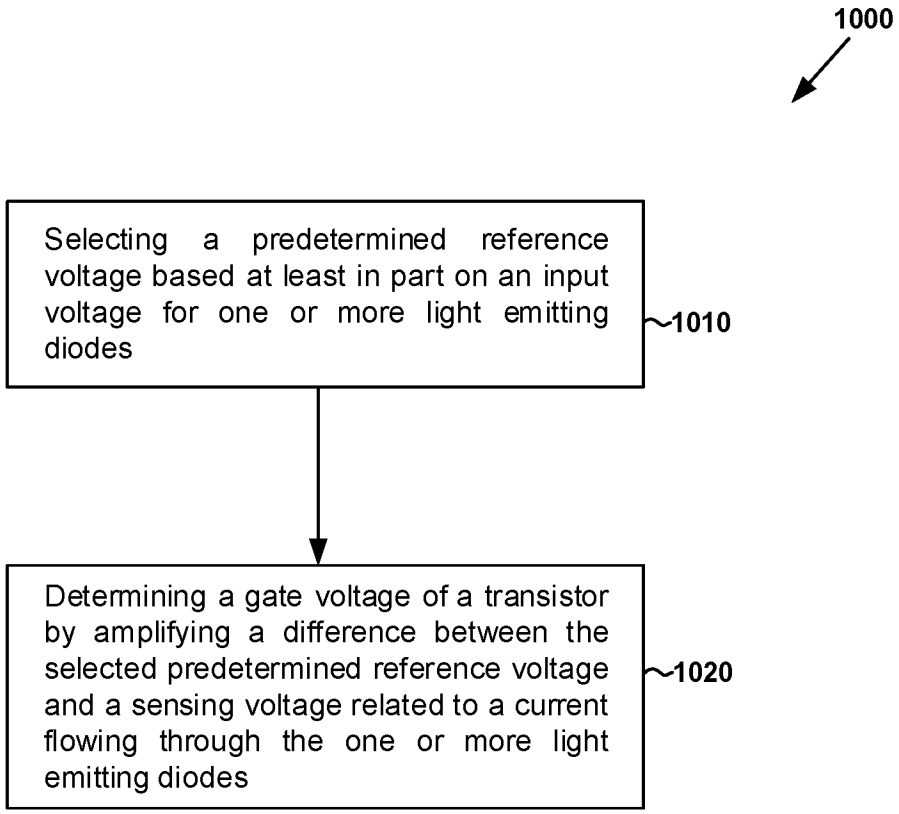
FIG. 10 is a simplified diagram showing a method for an LED lighting system according to some embodiments of the present invention.

FIG. 10 is a simplified diagram showing a method for an LED lighting system according to some embodiments of the present invention. This diagram is merely an example, which should not unduly limit the scope of the claims. One of ordinary skill in the art would recognize many variations, alternatives, and modifications. The method 1000 includes a process 1010 for selecting a predetermined reference voltage based at least in part on an input voltage for one or more light emitting diodes, and a process 1020 for determining a gate voltage of a transistor by amplifying a difference between the selected predetermined reference voltage and a sensing voltage related to a current flowing through the one or more light emitting diodes. As an example, the method 1000 is implemented according to at least FIG. 2, FIG. 5, FIG. 7, FIG. 8, and/or FIG. 9. For example, the method 1000 is used to perform segmented constant current control. Although the above has been shown using a selected group of processes for the method, there can be many alternatives, modifications, and variations. For example, some of the processes may be expanded and/or combined. Other processes may be inserted to those noted above. Depending upon the embodiment, the sequence of processes may be interchanged with others replaced.

At the process 1010, the predetermined reference voltage is selected based at least in part on the input voltage for the one or more light emitting diodes according to certain embodiments. For example, the predetermined reference voltage is selected from the multiple predetermined voltages that include the voltages $V_{ref_1}$, $V_{ref_2}$, . . . , and $V_{ref_n}$, where n is a positive integer equal to or larger than 2. As an example, the input voltage for the one or more light emitting diodes is the input voltage 212 (e.g., $V_{in}$) of the one or more LEDs 260, the input voltage 512 (e.g., $V_{in}$) of the one or more LEDs 560, the input voltage 712 (e.g., $V_{in}$) of the one or more LEDs 760, the input voltage 812 (e.g., $V_{in}$) of the one or more LEDs 860, and/or the input voltage 912 (e.g., $V_{in}$) of the one or more LEDs 960.

In some examples, the input voltage for the one or more light emitting diodes is generated by a bridge rectifier (e.g., the bridge rectifier 210, the bridge rectifier 510, the bridge rectifier 710, the bridge rectifier 810, and/or the bridge rectifier 910), and is detected by a voltage detector (e.g., the voltage detector 270, the voltage detector 570, the voltage detector 770, the voltage detector 870, and/or the voltage detector 970). As an example, the voltage detector uses the detected input voltage to generate one or more control signals (e.g., the control signal 272, the control signal 572, the control signal 772, the control signals 872 and 874, and/or the control signal 972). For example, the one or more control signals are used to select the predetermined reference voltage from the multiple predetermined voltages. As an example, when the input voltage (e.g., the input voltage 212, the input voltage 512, the input voltage 712, the input voltage 812, and/or the input voltage 912) increases, a voltage is selected from the multiple predetermined voltages such as that the reference voltage decreases in magnitude.

At the process 1020, the gate voltage of the transistor is determined by amplifying the difference between the selected predetermined reference voltage and the sensing voltage related to the current flowing through the one or more light emitting diodes. For example, the gate voltage of the transistor is the gate voltage 226 of the transistor 230, the gate voltage 528 of the transistor 530, the gate voltage 726 of the transistor 730, the gate voltage 826 of the transistor 830, and/or the gate voltage 928 of the transistor 930. As an example, the sensing voltage related to the current flowing through the one or more light emitting diodes is the sensing voltage 258 that corresponds to the magnitude of the current 262, the sensing voltage 558 that corresponds to the magnitude of the current 562, the sensing voltage 758 that corresponds to the magnitude of the current 762, the sensing voltage 858 that corresponds to the magnitude of the current 862, and/or the sensing voltage 958 that corresponds to the magnitude of the current 962.

Figure 11:
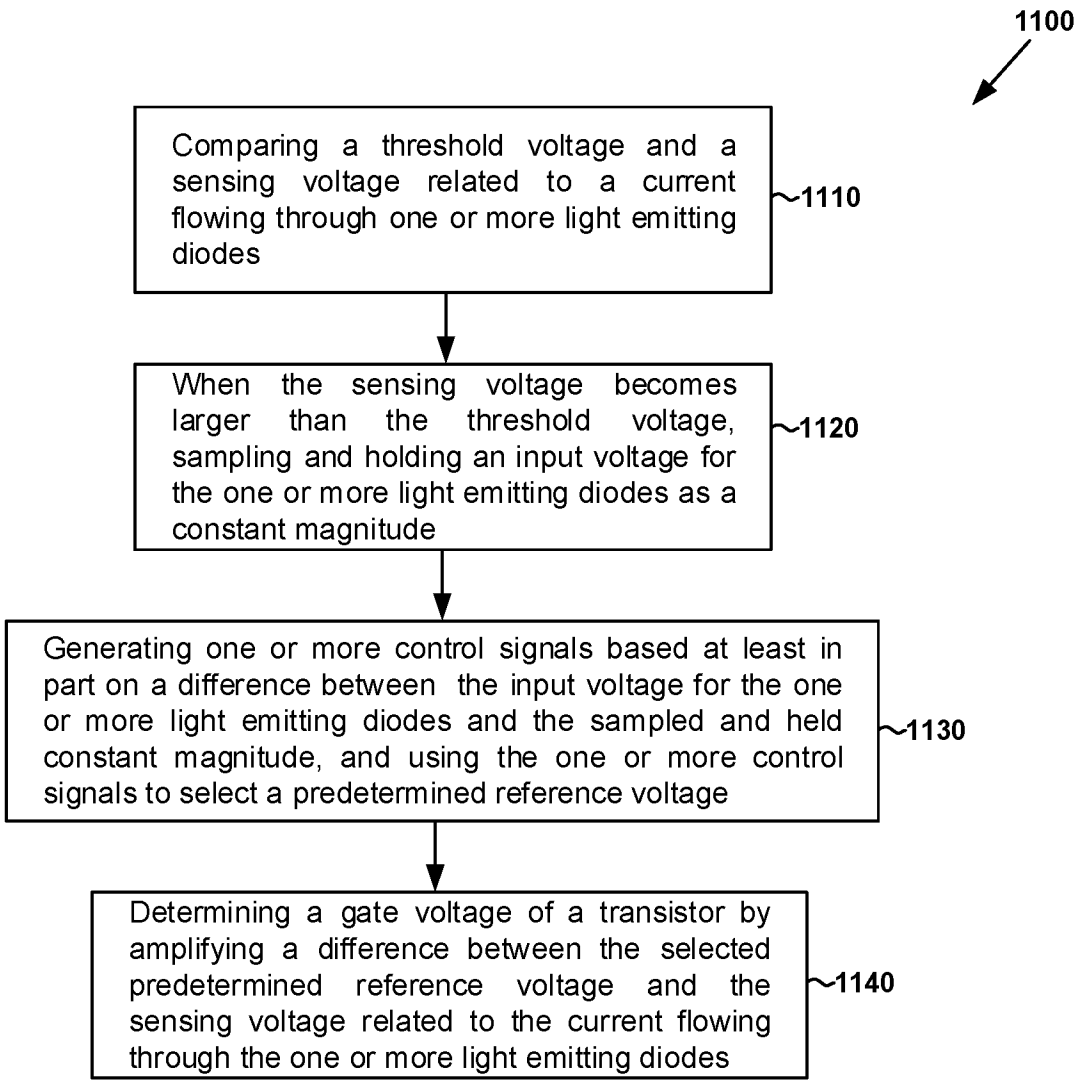
FIG. 11 is a simplified diagram showing a method for an LED lighting system according to certain embodiments of the present invention.

FIG. 11 is a simplified diagram showing a method for an LED lighting system according to certain embodiments of the present invention. This diagram is merely an example, which should not unduly limit the scope of the claims. One of ordinary skill in the art would recognize many variations, alternatives, and modifications. The method 1100 includes a process 1110 for comparing a threshold voltage and a sensing voltage related to a current flowing through one or more light emitting diodes, a process 1120 for, when the sensing voltage becomes larger than the threshold voltage, sampling and holding an input voltage for the one or more light emitting diodes as a constant magnitude, a process 1130 for generating one or more control signals based at least in part on a difference between the input voltage for the one or more light emitting diodes and the sampled and held constant magnitude, and using the one or more control signals to select a predetermined reference voltage, and a process 1140 for determining a gate voltage of a transistor by amplifying a difference between the selected predetermined reference voltage and the sensing voltage related to the current flowing through the one or more light emitting diodes. As an example, the method 1100 is implemented according to at least FIG. 3, together with FIG. 2, FIG. 5, FIG. 7, FIG. 8, and/or FIG. 9. For example, the method 1100 is used to perform segmented constant current control. Although the above has been shown using a selected group of processes for the method, there can be many alternatives, modifications, and variations. For example, some of the processes may be expanded and/or combined. Other processes may be inserted to those noted above. Depending upon the embodiment, the sequence of processes may be interchanged with others replaced.

At the process 1110, the threshold voltage is compared with the sensing voltage related to the current flowing through the one or more light emitting diodes according to some embodiments. As an example, the threshold voltage is the threshold voltage 282, the threshold voltage 582, the threshold voltage 782, the threshold voltage 882, and/or the threshold voltage 982. For example, the sensing voltage related to the current flowing through the one or more light emitting diodes is the sensing voltage 258 that corresponds to the magnitude of the current 262, the sensing voltage 558 that corresponds to the magnitude of the current 562, the sensing voltage 758 that corresponds to the magnitude of the current 762, the sensing voltage 858 that corresponds to the magnitude of the current 862, and/or the sensing voltage 958 that corresponds to the magnitude of the current 962.

At the process 1120, when the sensing voltage becomes larger than the threshold voltage, an input voltage for the one or more light emitting diodes is sampled and held as a constant magnitude according to certain embodiments. As an example, the input voltage for the one or more light emitting diodes is the input voltage 212 (e.g., $V_{in}$) of the one or more LEDs 260, the input voltage 512 (e.g., $V_{in}$) of the one or more LEDs 560, the input voltage 712 (e.g., $V_{in}$) of the one or more LEDs 760, the input voltage 812 (e.g., $V_{in}$) of the one or more LEDs 860, and/or the input voltage 912 (e.g., $V_{in}$) of the one or more LEDs 960. For example, the constant magnitude is the constant magnitude $V_{s_t}$ for the voltage 352 of the capacitor 350.

At the process 1130, one or more control signals are generated based at least in part on a difference between the input voltage for the one or more light emitting diodes and the sampled and held constant magnitude, and the one or more control signals are used to select a predetermined reference voltage, according to some embodiments. As an example, the one or more control signals are the control signal 272, the control signal 572, the control signal 772, the control signals 872 and 874, and/or the control signal 972. For example, the predetermined reference voltage is selected from multiple predetermined voltages that include the voltages $V_{ref_1}$, $V_{ref_2}$, . . . , and $V_{ref_n}$, where n is a positive integer equal to or larger than 2. As an example, when the input voltage (e.g., the input voltage 212, the input voltage 512, the input voltage 712, the input voltage 812, and/or the input voltage 912) increases, a voltage is selected from the multiple predetermined voltages such that the reference voltage decreases in magnitude.

At the process 1140, the gate voltage of the transistor is determined by amplifying the difference between the selected predetermined reference voltage and the sensing voltage related to the current flowing through the one or more light emitting diodes. As an example, the gate voltage of the transistor is the gate voltage 226 of the transistor 230, the gate voltage 528 of the transistor 530, the gate voltage 726 of the transistor 730, the gate voltage 826 of the transistor 830, and/or the gate voltage 928 of the transistor 930. For example, the sensing voltage related to the current flowing through the one or more light emitting diodes is the sensing voltage 258 that corresponds to the magnitude of the current 262, the sensing voltage 558 that corresponds to the magnitude of the current 562, the sensing voltage 758 that corresponds to the magnitude of the current 762, the sensing voltage 858 that corresponds to the magnitude of the current 862, and/or the sensing voltage 958 that corresponds to the magnitude of the current 962.

Certain embodiments of the present invention provide systems and methods for segmented constant current control. For example, the segmented constant current control is performed by detecting an input voltage to one or more light emitting diodes and detecting a current that flows through the one or more light emitting diodes so that the current that flows though the one or more light emitting diodes is regulated at a larger constant magnitude when the input voltage to the one or more light emitting diodes is smaller, and the current that flows though the one or more light emitting diodes is regulated at a smaller constant magnitude when the input voltage to the one or more light emitting diodes is larger. As an example, the light emitting diode (LED) lighting system has lower energy loss, with improved energy efficiency.

According to some embodiments, a system for current control includes: a transistor including a drain terminal, a gate terminal, and a source terminal, the drain terminal being coupled to one or more light emitting diodes; a resistor coupled to the source terminal of the transistor and configured to generate a resistor voltage related to a current flowing through the one or more emitting diodes; a voltage detector configured to receiver a first input voltage related to a second input voltage received by the one or more light emitting diodes; and a voltage controller coupled to the voltage detector, the resistor, and the gate terminal of the transistor; wherein the voltage detector is further configured to: detect the first input voltage; and generate a control signal based at least in part on the first input voltage; wherein the voltage controller is configured to: receive the control signal from the voltage detector; receive the resistor voltage from the resistor; use at least the resistor voltage and one reference voltage of a plurality of reference voltages based at least in part on the control signal to generate a gate voltage; and output the gate voltage to the gate terminal of the transistor; wherein: if the first input voltage becomes larger than a predetermined voltage magnitude, the one reference voltage changes from a first reference voltage of the plurality of reference voltages to a second reference voltage of the plurality of reference voltages; and if the first input voltage becomes smaller than the predetermined voltage magnitude, the one reference voltage changes from the second reference voltage to the first reference voltage; wherein the first reference voltage is larger than the second reference voltage. For example, the system is implemented according to at least FIG. 2, FIG. 5, FIG. 6, FIG. 7, FIG. 8, and/or FIG. 9.

In certain examples, the voltage controller includes a switch and an operational amplifier coupled to the switch; the switch is configured to: receive the control signal; select the one reference voltage from the plurality of reference voltages based at least in part on the control signal; and output the selected one reference voltage to the operational amplifier. In some examples, the voltage controller includes a plurality of operational amplifiers and a switch coupled to the plurality of operational amplifiers; the plurality of operational amplifiers are configured to: receive the plurality of reference voltages respectively; and generate a plurality of output voltages respectively; the switch is configured to: receive the control signal; select one output voltage from the plurality of output voltages based at least in part on the control signal; and output the selected one output voltage as the gate voltage.

In certain examples, the system further includes a voltage comparator configured to: receive the resistor voltage from the resistor and a threshold voltage; compare the resistor voltage and the threshold voltage; and generate a comparison signal based at least in part on the resistor voltage and the threshold voltage; wherein the voltage comparator is further configured to: generate the comparison signal at a first logic level if the resistor voltage is smaller than the threshold voltage; and generate the comparison signal at a second logic level if the resistor voltage is larger than the threshold voltage, the second logic level being different from the first logic level. In some examples, the voltage detector is further configured to: receive the comparison signal; when the comparison signal changes from the first logic level to the second logic level, hold a magnitude of the first input voltage as the predetermined voltage magnitude; and generate the control signal based at least in part on a difference between the first input voltage and the predetermined voltage magnitude. In certain examples, the voltage detector includes: a switch configured to receive the comparison signal and including a first switch terminal and a second switch terminal, the first switch terminal configured to receive the first input voltage; a capacitor including a first capacitor terminal and a second capacitor terminal, the first capacitor terminal being coupled to the second switch terminal; and a plurality of comparators, each comparator of the plurality of comparators including a comparator terminal coupled to the first capacitor terminal.

In some examples, the switch is configured to change from being closed to being open in response to the comparison signal changing from the first logic level to the second logic level; the capacitor is configured to, in response to the switch changing from being closed to being open, hold the magnitude of the first input voltage as the predetermined voltage magnitude and output the predetermined voltage magnitude to the first capacitor terminal of the each comparator of the plurality of comparators; and the plurality of comparators are configured to change the control signal based at least in part on a change in a difference between the first input voltage and the predetermined voltage magnitude. In certain examples, the voltage controller is configured to change the one reference voltage of the plurality of reference voltages based at least in part on a change in the control signal.

In some examples, the voltage detector is further configured to receiver the first input voltage from a voltage divider configured to receive the second input voltage; and the first input voltage is directly proportional to the second input voltage. In certain examples, the voltage controller includes an operational amplifier and a capacitor, the operational amplifier including a first amplifier terminal, a second amplifier terminal and a third amplifier terminal, the capacitor including a first capacitor terminal and a second capacitor terminal; wherein: the first amplifier terminal is configured to receive a predetermined reference voltage of the plurality of reference voltages; the second amplifier terminal is configured to receive the resistor voltage; and the third amplifier terminal is coupled to the first capacitor terminal; wherein the operation amplifier is configured to, if the predetermined reference voltage of the plurality of reference voltages is selected to be the one reference voltage, generate the gate voltage with the capacitor. In some examples, the predetermined reference voltage of the plurality of reference voltages is the largest reference voltage of the plurality of reference voltages; and the second capacitor terminal is biased to a ground voltage.

In certain examples, the voltage controller includes a first operational amplifier, a capacitor, and a second operational amplifier; the first operational amplifier includes a first amplifier terminal, a second amplifier terminal and a third amplifier terminal; the capacitor includes a first capacitor terminal and a second capacitor terminal; the second operational amplifier includes a fourth amplifier terminal, a fifth amplifier terminal and a sixth amplifier terminal; wherein: the first amplifier terminal is configured to receive a predetermined reference voltage of the plurality of reference voltages; the second amplifier terminal is configured to receive the resistor voltage; and the third amplifier terminal is coupled to the first capacitor terminal; wherein the first operational amplifier is configured to: generate an amplified voltage with the capacitor at the third amplifier terminal; and if the predetermined reference voltage of the plurality of reference voltages is selected to be the one reference voltage, output the amplified voltage from the third amplifier terminal to the fourth amplifier terminal; wherein: the fifth amplifier terminal is configured to receive the resistor voltage; and the sixth amplifier terminal is configured to output the gate voltage to the gate terminal of the transistor. In some examples, the predetermined reference voltage of the plurality of reference voltages is the largest reference voltage of the plurality of reference voltages; and the second capacitor terminal is biased to a ground voltage.

In certain examples, the voltage controller includes a first operational amplifier, a capacitor, and one or more second operational amplifiers, the first operational amplifier including a first amplifier terminal, a second amplifier terminal and a third amplifier terminal, the capacitor including a first capacitor terminal and a second capacitor terminal; wherein: the first amplifier terminal is configured to receive a predetermined reference voltage of the plurality of reference voltages; the second amplifier terminal is configured to receive the resistor voltage; and the third amplifier terminal is coupled to the first capacitor terminal; wherein: the first operational amplifier is configured to generate a first amplified voltage with the capacitor; and the one or more second operational amplifiers are configured to: receive one or more reference voltages of the plurality of reference voltages, each of the one or more reference voltages being different from the predetermined reference voltage; and generate one or more second amplified voltages bases at least in part on the one or more reference voltages respectively; wherein the first operational amplifier is configured to, if the predetermined reference voltage of the plurality of reference voltages is selected to be the one reference voltage, output the first amplified voltage as the gate voltage. In some examples, the one or more second operational amplifiers are configured to, if the predetermined reference voltage of the plurality of reference voltages is not selected to be the one reference voltage, output one amplified voltage of the one or more second amplified voltages as the gate voltage. In certain examples, the predetermined reference voltage of the plurality of reference voltages is the largest reference voltage of the plurality of reference voltages; and the second capacitor terminal is biased to a ground voltage.

According to certain embodiments, a method for current control includes: receiving, by a resistor, a current flowing through one or more light emitting diodes, the resistor being coupled to a source terminal of a transistor, the transistor further including a gate terminal and a drain terminal coupled to the one or more light emitting diodes; generating a resistor voltage related to the current flowing through the one or more emitting diodes; receiving a first input voltage related to a second input voltage received by the one or more light emitting diodes; detecting the first input voltage; generating a control signal based at least in part on the first input voltage; receiving the resistor voltage and the control signal; using at least the resistor voltage and one reference voltage of a plurality of reference voltages based at least in part on the control signal to generate a gate voltage; and outputting the gate voltage to the gate terminal of the transistor; wherein: if the first input voltage becomes larger than a predetermined voltage magnitude, the one reference voltage changes from a first reference voltage of the plurality of reference voltages to a second reference voltage of the plurality of reference voltages; and if the first input voltage becomes smaller than the predetermined voltage magnitude, the one reference voltage changes from the second reference voltage to the first reference voltage; wherein the first reference voltage is larger than the second reference voltage. For example, the method is implemented according to at least FIG. 2, FIG. 5, FIG. 6, FIG. 7, FIG. 8, FIG. 9, and/or FIG. 10.

In some examples, the using at least the resistor voltage and one reference voltage of a plurality of reference voltages based at least in part on the control signal to generate a gate voltage includes: selecting the one reference voltage from the plurality of reference voltages based at least in part on the control signal; determining a difference between the resistor voltage and the selected one reference voltage; and generating the gate voltage based at least in part on the difference between the resistor voltage and the selected one reference voltage. In certain examples, the using at least the resistor voltage and one reference voltage of a plurality of reference voltages based at least in part on the control signal to generate a gate voltage includes: receiving the plurality of reference voltages respectively; determining a plurality of differences between the plurality of reference voltages and the resistor voltage respectively; generating a plurality of output voltages based at least in part on the plurality of differences respectively; selecting one output voltage from the plurality of output voltages based at least in part on the control signal; and generating the selected one output voltage as the gate voltage.

In some examples, the method further includes: receiving the resistor voltage from the resistor and a threshold voltage; comparing the resistor voltage and the threshold voltage; and generating a comparison signal based at least in part on the resistor voltage and the threshold voltage; wherein the generating a comparison signal based at least in part on the resistor voltage and the threshold voltage includes: generating the comparison signal at a first logic level if the resistor voltage is smaller than the threshold voltage; and generating the comparison signal at a second logic level if the resistor voltage is larger than the threshold voltage, the second logic level being different from the first logic level. In certain examples, the generating a control signal based at least in part on the first input voltage includes: receiving the comparison signal; when the comparison signal changes from the first logic level to the second logic level, holding a magnitude of the first input voltage as the predetermined voltage magnitude; and generating the control signal based at least in part on a difference between the first input voltage and the predetermined voltage magnitude.

For example, some or all components of various embodiments of the present invention each are, individually and/or in combination with at least another component, implemented using one or more software components, one or more hardware components, and/or one or more combinations of software and hardware components. In another example, some or all components of various embodiments of the present invention each are, individually and/or in combination with at least another component, implemented in one or more circuits, such as one or more analog circuits and/or one or more digital circuits. In yet another example, various embodiments and/or examples of the present invention can be combined.

Although specific embodiments of the present invention have been described, it will be understood by those of skill in the art that there are other embodiments that are equivalent to the described embodiments. Accordingly, it is to be understood that the invention is not to be limited by the specific illustrated embodiments.

What is claimed is:

1. A system for current control, the system comprising:

a transistor including a drain terminal, a gate terminal, and a source terminal, the drain terminal being coupled to one or more light emitting diodes;

a resistor coupled to the source terminal of the transistor and configured to generate a resistor voltage related to a current flowing through the one or more emitting diodes;

a voltage detector configured to receive a first input voltage related to a second input voltage received by the one or more light emitting diodes;

a voltage controller coupled to the voltage detector, the resistor, and the gate terminal of the transistor; and a voltage comparator configured to:

receive the resistor voltage from the resistor and a threshold voltage;

compare the resistor voltage and the threshold voltage; and generate a comparison signal based at least in part on the resistor voltage and the threshold voltage;

wherein the voltage comparator is further configured to:

generate the comparison signal at a first logic level if the resistor voltage is smaller than the threshold voltage; and generate the comparison signal at a second logic level if the resistor voltage is larger than the threshold voltage, the second logic level being different from the first logic level;

wherein the voltage detector is further configured to:

detect the first input voltage; and generate a control signal based at least in part on the first input voltage;

wherein the voltage controller is configured to:

receive the control signal from the voltage detector;

receive the resistor voltage from the resistor;

use at least the resistor voltage and one reference voltage of a plurality of reference voltages based at least in part on the control signal to generate a gate voltage; and output the gate voltage to the gate terminal of the transistor;

wherein:

if the first input voltage becomes larger than a predetermined voltage magnitude, the one reference voltage changes from a first reference voltage of the plurality of reference voltages to a second reference voltage of the plurality of reference voltages; and if the first input voltage becomes smaller than the predetermined voltage magnitude, the one reference voltage changes from the second reference voltage to the first reference voltage;

wherein the first reference voltage is larger than the second reference voltage;

wherein the voltage detector is further configured to:

receive the comparison signal;

when the comparison signal changes from the first logic level to the second logic level, hold a magnitude of the first input voltage as the predetermined voltage magnitude; and generate the control signal based at least in part on a difference between the first input voltage and the predetermined voltage magnitude.

2. The system of claim 1 wherein:

the voltage controller includes a switch and an operational amplifier coupled to the switch;

the switch is configured to:

receive the control signal;

select the one reference voltage from the plurality of reference voltages based at least in part on the control signal; and output the selected one reference voltage to the operational amplifier.

3. The system of claim 1 wherein:

the voltage controller includes a plurality of operational amplifiers and a switch coupled to the plurality of operational amplifiers;

the plurality of operational amplifiers are configured to:

receive the plurality of reference voltages respectively; and generate a plurality of output voltages respectively;

the switch is configured to:

receive the control signal;

select one output voltage from the plurality of output voltages based at least in part on the control signal; and output the selected one output voltage as the gate voltage.

4. The system of claim 1 wherein:

the voltage detector is further configured to receive the first input voltage from a voltage divider;

the voltage divider is configured to receive the second input voltage; and the first input voltage is directly proportional to the second input voltage.

5. The system of claim 1 wherein:

the voltage controller includes an operational amplifier and a capacitor, the operational amplifier including a first amplifier terminal, a second amplifier terminal and a third amplifier terminal, the capacitor including a first capacitor terminal and a second capacitor terminal;

wherein:

the first amplifier terminal is configured to receive a predetermined reference voltage of the plurality of reference voltages;

the second amplifier terminal is configured to receive the resistor voltage; and the third amplifier terminal is coupled to the first capacitor terminal;

wherein the operation amplifier is configured to, if the predetermined reference voltage of the plurality of reference voltages is selected to be the one reference voltage, generate the gate voltage with the capacitor.

6. The system of claim 5 wherein:

the predetermined reference voltage of the plurality of reference voltages is the largest reference voltage of the plurality of reference voltages; and the second capacitor terminal is biased to a ground voltage.

7. The system of claim 1 wherein:

the voltage controller includes a first operational amplifier, a capacitor, and a second operational amplifier;

the first operational amplifier includes a first amplifier terminal, a second amplifier terminal and a third amplifier terminal;

the capacitor includes a first capacitor terminal and a second capacitor terminal; and the second operational amplifier includes a fourth amplifier terminal, a fifth amplifier terminal and a sixth amplifier terminal;

wherein:

the first amplifier terminal is configured to receive a predetermined reference voltage of the plurality of reference voltages;

the second amplifier terminal is configured to receive the resistor voltage; and the third amplifier terminal is coupled to the first capacitor terminal;

wherein the first operational amplifier is configured to:

generate an amplified voltage with the capacitor at the third amplifier terminal; and if the predetermined reference voltage of the plurality of reference voltages is selected to be the one reference voltage, output the amplified voltage from the third amplifier terminal to the fourth amplifier terminal;

wherein:

the fifth amplifier terminal is configured to receive the resistor voltage; and the sixth amplifier terminal is configured to output the gate voltage to the gate terminal of the transistor.

8. The system of claim 7 wherein:

the predetermined reference voltage of the plurality of reference voltages is the largest reference voltage of the plurality of reference voltages; and the second capacitor terminal is biased to a ground voltage.

9. The system of claim 1 wherein:

the voltage controller includes a first operational amplifier, a capacitor, and one or more second operational amplifiers, the first operational amplifier including a first amplifier terminal, a second amplifier terminal and a third amplifier terminal, the capacitor including a first capacitor terminal and a second capacitor terminal;

wherein:

the first amplifier terminal is configured to receive a predetermined reference voltage of the plurality of reference voltages;

the second amplifier terminal is configured to receive the resistor voltage; and the third amplifier terminal is coupled to the first capacitor terminal;

wherein:

the first operational amplifier is configured to generate a first amplified voltage with the capacitor; and the one or more second operational amplifiers are configured to:

receive one or more reference voltages of the plurality of reference voltages, each of the one or more reference voltages being different from the predetermined reference voltage; and generate one or more second amplified voltages bases at least in part on the one or more reference voltages respectively;

wherein the first operational amplifier is configured to, if the predetermined reference voltage of the plurality of reference voltages is selected to be the one reference voltage, output the first amplified voltage as the gate voltage.

10. The system of claim 9 wherein the one or more second operational amplifiers are configured to, if the predetermined reference voltage of the plurality of reference voltages is not selected to be the one reference voltage, output one amplified voltage of the one or more second amplified voltages as the gate voltage.

11. The system of claim 9 wherein:

the predetermined reference voltage of the plurality of reference voltages is the largest reference voltage of the plurality of reference voltages; and the second capacitor terminal is biased to a ground voltage.

12. A system for current control, the system comprising:

a transistor including a drain terminal, a gate terminal, and a source terminal, the drain terminal being coupled to one or more light emitting diodes;

a resistor coupled to the source terminal of the transistor and configured to generate a resistor voltage related to a current flowing through the one or more emitting diodes;

a voltage detector configured to receive a first input voltage related to a second input voltage received by the one or more light emitting diodes;

a voltage controller coupled to the voltage detector, the resistor, and the gate terminal of the transistor; and a voltage comparator configured to:

receive the resistor voltage from the resistor and a threshold voltage;

compare the resistor voltage and the threshold voltage; and generate a comparison signal based at least in part on the resistor voltage and the threshold voltage;

wherein the voltage comparator is further configured to:

generate the comparison signal at a first logic level if the resistor voltage is smaller than the threshold voltage; and generate the comparison signal at a second logic level if the resistor voltage is larger than the threshold voltage, the second logic level being different from the first logic level;

wherein the voltage detector is further configured to:

detect the first input voltage; and generate a control signal based at least in part on the first input voltage;

wherein the voltage controller is configured to:

receive the control signal from the voltage detector;

receive the resistor voltage from the resistor;

use at least the resistor voltage and one reference voltage of a plurality of reference voltages based at least in part on the control signal to generate a gate voltage; and output the gate voltage to the gate terminal of the transistor;

wherein:

if the first input voltage becomes larger than a predetermined voltage magnitude, the one reference voltage changes from a first reference voltage of the plurality of reference voltages to a second reference voltage of the plurality of reference voltages; and if the first input voltage becomes smaller than the predetermined voltage magnitude, the one reference voltage changes from the second reference voltage to the first reference voltage;

wherein the first reference voltage is larger than the second reference voltage;

wherein the voltage detector includes:

a switch configured to receive the comparison signal and including a first switch terminal and a second switch terminal, the first switch terminal configured to receive the first input voltage;

a capacitor including a first capacitor terminal and a second capacitor terminal, the first capacitor terminal being coupled to the second switch terminal; and a plurality of comparators, each comparator of the plurality of comparators including a comparator terminal coupled to the first capacitor terminal.

13. The system of claim 12 wherein:

the switch is configured to change from being closed to being open in response to the comparison signal changing from the first logic level to the second logic level;

the capacitor is configured to, in response to the switch changing from being closed to being open, hold the magnitude of the first input voltage as the predetermined voltage magnitude and output the predetermined voltage magnitude to the first capacitor terminal of the each comparator of the plurality of comparators; and the plurality of comparators are configured to change the control signal based at least in part on a change in a difference between the first input voltage and the predetermined voltage magnitude.

14. The system of claim 13 wherein the voltage controller is configured to change the one reference voltage of the plurality of reference voltages based at least in part on a change in the control signal.

15. The system of claim 12 wherein:

the voltage controller includes a second switch and an operational amplifier coupled to the second switch;

the second switch is configured to:

receive the control signal;

select the one reference voltage from the plurality of reference voltages based at least in part on the control signal; and output the selected one reference voltage to the operational amplifier.

16. The system of claim 12 wherein:

the voltage controller includes a plurality of operational amplifiers and a second switch coupled to the plurality of operational amplifiers;

the plurality of operational amplifiers are configured to:

receive the plurality of reference voltages respectively; and generate a plurality of output voltages respectively; and the second switch is configured to:

receive the control signal;

select one output voltage from the plurality of output voltages based at least in part on the control signal; and output the selected one output voltage as the gate voltage.

17. The system of claim 12 wherein:

the voltage detector is further configured to receive the first input voltage from a voltage divider;

the voltage divider is configured to receive the second input voltage; and the first input voltage is directly proportional to the second input voltage.

18. The system of claim 12 wherein:

the voltage controller includes an operational amplifier and a capacitor, the operational amplifier including a first amplifier terminal, a second amplifier terminal and a third amplifier terminal, the capacitor including a first capacitor terminal and a second capacitor terminal;

wherein:

the first amplifier terminal is configured to receive a predetermined reference voltage of the plurality of reference voltages;

the second amplifier terminal is configured to receive the resistor voltage; and the third amplifier terminal is coupled to the first capacitor terminal;

wherein the operation amplifier is configured to, if the predetermined reference voltage of the plurality of reference voltages is selected to be the one reference voltage, generate the gate voltage with the capacitor.

19. The system of claim 18 wherein:

the predetermined reference voltage of the plurality of reference voltages is the largest reference voltage of the plurality of reference voltages; and the second capacitor terminal is biased to a ground voltage.

20. The system of claim 12 wherein:

the voltage controller includes a first operational amplifier, a capacitor, and a second operational amplifier;

the first operational amplifier includes a first amplifier terminal, a second amplifier terminal and a third amplifier terminal;

the capacitor includes a first capacitor terminal and a second capacitor terminal; and the second operational amplifier includes a fourth amplifier terminal, a fifth amplifier terminal and a sixth amplifier terminal;

wherein:

the first amplifier terminal is configured to receive a predetermined reference voltage of the plurality of reference voltages;

the second amplifier terminal is configured to receive the resistor voltage; and the third amplifier terminal is coupled to the first capacitor terminal;

wherein the first operational amplifier is configured to:

generate an amplified voltage with the capacitor at the third amplifier terminal; and if the predetermined reference voltage of the plurality of reference voltages is selected to be the one reference voltage, output the amplified voltage from the third amplifier terminal to the fourth amplifier terminal;

wherein:

the fifth amplifier terminal is configured to receive the resistor voltage; and the sixth amplifier terminal is configured to output the gate voltage to the gate terminal of the transistor.

21. The system of claim 20 wherein:

the predetermined reference voltage of the plurality of reference voltages is the largest reference voltage of the plurality of reference voltages; and the second capacitor terminal is biased to a ground voltage.

22. The system of claim 12 wherein:

the voltage controller includes a first operational amplifier, a capacitor, and one or more second operational amplifiers, the first operational amplifier including a first amplifier terminal, a second amplifier terminal and a third amplifier terminal, the capacitor including a first capacitor terminal and a second capacitor terminal;

wherein:

the first amplifier terminal is configured to receive a predetermined reference voltage of the plurality of reference voltages;

the second amplifier terminal is configured to receive the resistor voltage; and the third amplifier terminal is coupled to the first capacitor terminal;

wherein:

the first operational amplifier is configured to generate a first amplified voltage with the capacitor; and the one or more second operational amplifiers are configured to:

receive one or more reference voltages of the plurality of reference voltages, each of the one or more reference voltages being different from the predetermined reference voltage; and generate one or more second amplified voltages bases at least in part on the one or more reference voltages respectively;

wherein the first operational amplifier is configured to, if the predetermined reference voltage of the plurality of reference voltages is selected to be the one reference voltage, output the first amplified voltage as the gate voltage.

23. The system of claim 22 wherein the one or more second operational amplifiers are configured to, if the predetermined reference voltage of the plurality of reference voltages is not selected to be the one reference voltage, output one amplified voltage of the one or more second amplified voltages as the gate voltage.

24. The system of claim 22 wherein:

the predetermined reference voltage of the plurality of reference voltages is the largest reference voltage of the plurality of reference voltages; and the second capacitor terminal is biased to a ground voltage.

25. A method for current control, the method comprising:

receiving, by a resistor, a current flowing through one or more light emitting diodes, the resistor being coupled to a source terminal of a transistor, the transistor further including a gate terminal and a drain terminal coupled to the one or more light emitting diodes;

generating a resistor voltage related to the current flowing through the one or more emitting diodes;

receiving a first input voltage related to a second input voltage received by the one or more light emitting diodes;

detecting the first input voltage;

generating a control signal based at least in part on the first input voltage;

receiving the resistor voltage and the control signal;

using at least the resistor voltage and one reference voltage of a plurality of reference voltages based at least in part on the control signal to generate a gate voltage;

outputting the gate voltage to the gate terminal of the transistor;

receiving the resistor voltage from the resistor and a threshold voltage;

comparing the resistor voltage and the threshold voltage; and generating a comparison signal based at least in part on the resistor voltage and the threshold voltage;

wherein:

if the first input voltage becomes larger than a predetermined voltage magnitude, the one reference voltage changes from a first reference voltage of the plurality of reference voltages to a second reference voltage of the plurality of reference voltages; and if the first input voltage becomes smaller than the predetermined voltage magnitude, the one reference voltage changes from the second reference voltage to the first reference voltage;

wherein the first reference voltage is larger than the second reference voltage;

wherein the generating a comparison signal based at least in part on the resistor voltage and the threshold voltage includes:

generating the comparison signal at a first logic level if the resistor voltage is smaller than the threshold voltage; and generating the comparison signal at a second logic level if the resistor voltage is larger than the threshold voltage, the second logic level being different from the first logic level;

wherein the generating a control signal based at least in part on the first input voltage includes:

receiving the comparison signal;

when the comparison signal changes from the first logic level to the second logic level, holding a magnitude of the first input voltage as the predetermined voltage magnitude; and generating the control signal based at least in part on a difference between the first input voltage and the predetermined voltage magnitude.

26. The method of claim 25 wherein the using at least the resistor voltage and one reference voltage of a plurality of reference voltages based at least in part on the control signal to generate a gate voltage includes:

selecting the one reference voltage from the plurality of reference voltages based at least in part on the control signal;

determining a difference between the resistor voltage and the selected one reference voltage; and generating the gate voltage based at least in part on the difference between the resistor voltage and the selected one reference voltage.

27. The method of claim 25 wherein the using at least the resistor voltage and one reference voltage of a plurality of reference voltages based at least in part on the control signal to generate a gate voltage includes:

receiving the plurality of reference voltages respectively;

determining a plurality of differences between the plurality of reference voltages and the resistor voltage respectively;

generating a plurality of output voltages based at least in part on the plurality of differences respectively;

selecting one output voltage from the plurality of output voltages based at least in part on the control signal; and generating the selected one output voltage as the gate voltage.

28. A method for current control, the method comprising:

receiving, by a resistor, a current flowing through one or more light emitting diodes, the resistor being coupled to a source terminal of a transistor, the transistor further including a gate terminal and a drain terminal coupled to the one or more light emitting diodes;

generating a resistor voltage related to the current flowing through the one or more emitting diodes;

receiving, by a voltage detector, a first input voltage related to a second input voltage received by the one or more light emitting diodes;

detecting the first input voltage;

generating a control signal based at least in part on the first input voltage;

receiving the resistor voltage and the control signal;

using at least the resistor voltage and one reference voltage of a plurality of reference voltages based at least in part on the control signal to generate a gate voltage;

outputting the gate voltage to the gate terminal of the transistor;

receiving the resistor voltage from the resistor and a threshold voltage;

comparing the resistor voltage and the threshold voltage; and generating a comparison signal based at least in part on the resistor voltage and the threshold voltage;

wherein:

if the first input voltage becomes larger than a predetermined voltage magnitude, the one reference voltage changes from a first reference voltage of the plurality of reference voltages to a second reference voltage of the plurality of reference voltages; and if the first input voltage becomes smaller than the predetermined voltage magnitude, the one reference voltage changes from the second reference voltage to the first reference voltage;

wherein the first reference voltage is larger than the second reference voltage;

wherein the generating a comparison signal based at least in part on the resistor voltage and the threshold voltage includes:

generating the comparison signal at a first logic level if the resistor voltage is smaller than the threshold voltage; and generating the comparison signal at a second logic level if the resistor voltage is larger than the threshold voltage, the second logic level being different from the first logic level;

wherein the voltage detector includes:

a switch configured to receive the comparison signal and including a first switch terminal and a second switch terminal, the first switch terminal configured to receive the first input voltage;

a capacitor including a first capacitor terminal and a second capacitor terminal, the first capacitor terminal being coupled to the second switch terminal; and a plurality of comparators, each comparator of the plurality of comparators including a comparator terminal coupled to the first capacitor terminal.

29. The method of claim 28 wherein the using at least the resistor voltage and one reference voltage of a plurality of reference voltages based at least in part on the control signal to generate a gate voltage includes:

selecting the one reference voltage from the plurality of reference voltages based at least in part on the control signal;

determining a difference between the resistor voltage and the selected one reference voltage; and generating the gate voltage based at least in part on the difference between the resistor voltage and the selected one reference voltage.

30. The method of claim 28 wherein the using at least the resistor voltage and one reference voltage of a plurality of reference voltages based at least in part on the control signal to generate a gate voltage includes:

receiving the plurality of reference voltages respectively;

determining a plurality of differences between the plurality of reference voltages and the resistor voltage respectively;

generating a plurality of output voltages based at least in part on the plurality of differences respectively;

selecting one output voltage from the plurality of output voltages based at least in part on the control signal; and generating the selected one output voltage as the gate voltage.

* * * * *